United States Patent [19]

Stahlecker et al.

[11] 4,125,990

[45] Nov. 21, 1978

[54] OPEN-END SPINNING MACHINE

[75] Inventors: Fritz Stahlecker, Josef-Neidhart-Str. 18, 7341 Bad Überkingen; Heinz Kamp, Rickelrath; Hans Raasch, Mönchengladbach, both of Germany

[73] Assignees: Fritz Stahlecker; Hans Stahlecker; W. Schlafhorst & Co., all of Germany

[21] Appl. No.: 658,532

[22] Filed: Feb. 17, 1976

[30] Foreign Application Priority Data

Feb. 14, 1975 [DE] Fed. Rep. of Germany ..... 2506362

[51] Int. Cl.[2] ..... D01H 9/00; D01H 15/00; B65H 54/26

[52] U.S. Cl. ..... 57/263; 57/269; 242/18 PW; 242/35.5 A; 242/35.6 R; 57/270; 57/302; 57/304

[58] Field of Search ..... 242/35.5 R, 35.5 A, 242/18 DD, 18 A, 18 PW, 18 R, 35.6 R; 57/34 R, 58.89, 58.91, 58.93, 58.95, 52, 53

[56] References Cited

U.S. PATENT DOCUMENTS

| | | | |
|---|---|---|---|
| 1,267,977 | 5/1918 | Colman | 242/35.6 R |
| 1,268,684 | 6/1918 | Colman | 242/35.6 R |
| 1,700,425 | 1/1929 | Abbott et al. | 242/35.6 R |
| 2,757,874 | 8/1956 | Marcellus | 242/35.6 R |
| 3,640,059 | 2/1972 | Lutovsky et al. | 242/35.6 R X |
| 3,791,126 | 2/1974 | Kose et al. | 242/18 R UX |
| 3,820,730 | 6/1974 | Endo et al. | 242/35.5 R |
| 3,858,385 | 1/1975 | Shinkai et al. | 57/34 R |
| 3,952,959 | 4/1976 | Shaw et al. | 242/18 PW |

*Primary Examiner*—Stanley N. Gilreath
*Attorney, Agent, or Firm*—Craig & Antonelli

[57] ABSTRACT

Apparatus for accommodating changing of bobbins on open-end spinning machines. Spooling devices are provided for joining a thread reserve section and a starting winding to an empty spool tube which is to be inserted in place of a completed bobbin. The spooling devices are constructed to form a starting winding of sufficient length to form a plurality of one-time piecing operations at a spinning station. A spool transfer device is provided for transferring a prepared spool with starting winding and reserve thread section into a bobbin holder. In certain preferred embodiments the spooling device is carried on a movable unit which travels along the spinning stations and includes an auxiliary bobbin for supplying the reserve and starting winding thread section. In other preferred embodiments, the spooling device is provided separate from the movable unit along the spinning machine and includes apparatus for forming and storing a plurality of pre-prepared bobbins. In the last-mentioned embodiment, the moving device and the spooling device include means for transferring the store of prepared starting bobbins to the moving device so that they can then be transferred to the respective bobbins.

79 Claims, 36 Drawing Figures

Fig.5
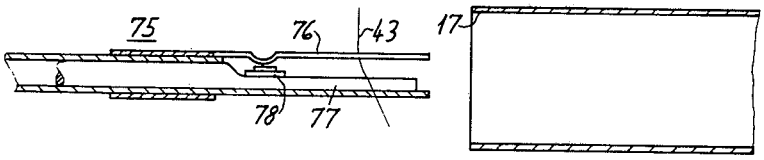
Fig.6
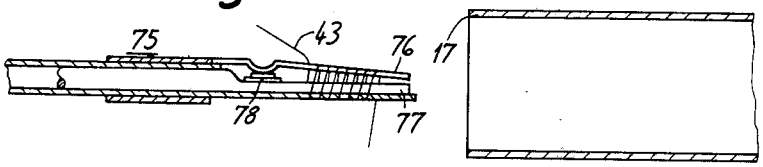
Fig.7
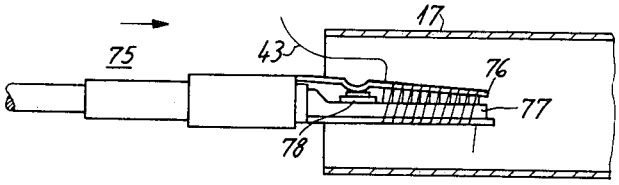
Fig.8
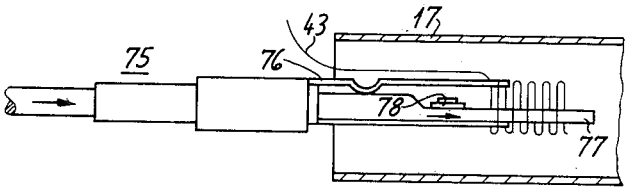
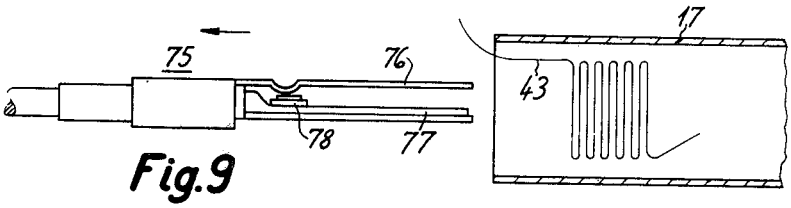
Fig.9

Fig.20
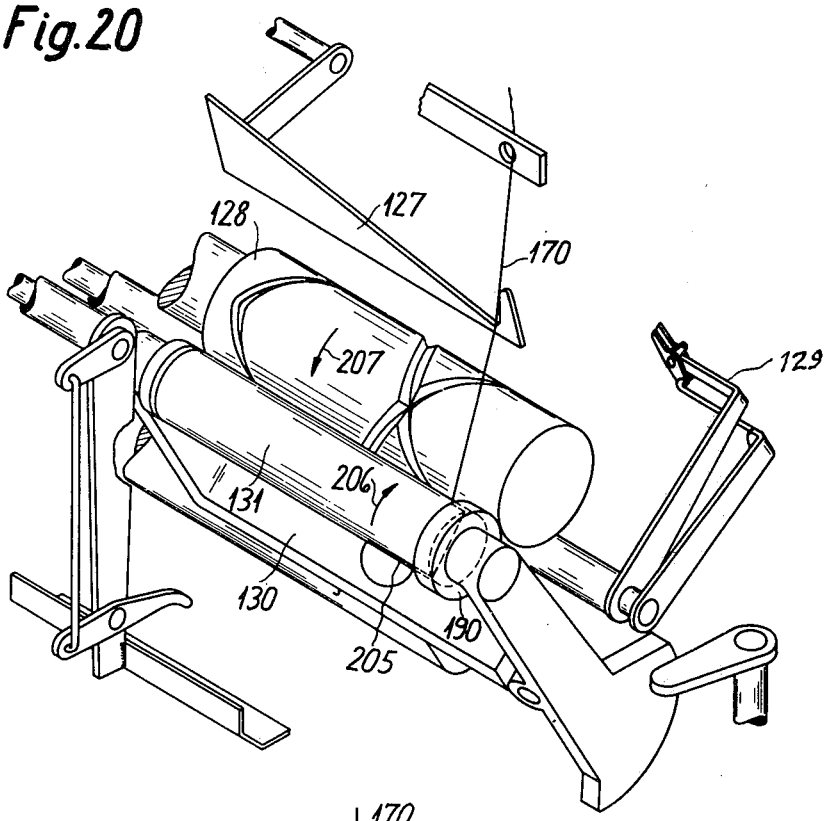
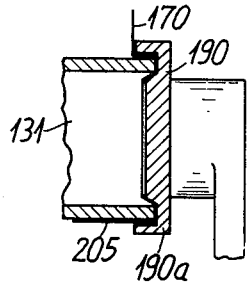
Fig.20a

OPEN-END SPINNING MACHINE

BACKGROUND AND SUMMARY OF THE INVENTION

The invention relates to apparatus for changing bobbins on a spinning machine or the like. Preferred embodiments of this invention relate to open-end spinning machines with several spinning stations and with at least one bobbin changer movable relatively to the spinning stations.

It has been contemplated to employ bobbin changers for exchanging the winding spools on spooling machines and double twisting machines (two-for-one twisters), wherein these bobbin changers serve for the operation of several operating stations, i.e. spooling stations in case of spooling machines or twisting stations in case of twisting machines. For this purpose the operating stations and the bobbin changers can be moved relatively to each other; preferably the bobbin changers are mounted to be movable along the operating stations. In these devices, the provision is made that the production process of the respective machine is interrupted during the bobbin changing procedure.

It has also been contemplated to provide bobbin changers in connection with open-end spinning machines and to fashion these changers as mobile, automatically operating servicing devices (U.S. Pat. Nos. 3,791,126 and 3,820,730; DOS's (German Unexamined Laid-Open Applications) Nos. 2,306,907; 2,308,682; 2,312,609; and 2,347,783). These types of construction, intended for open-end spinning machines, have the basic idea in common that the spinning operation is not interrupted during the exchange of the bobbin for a tube or quill. This basic idea is likewise utilized in another type of structure (British Pat. No. 1,166,504) wherein each individual spinning station is associated with its own device for exchanging the bobbins for a tube.

In the conventional types of construction, the spun thread is subjected to special mechanical stresses during the bobbin-change step, resulting in the ever-present danger that a thread break occurs during this bobbin-change operation. Such a thread break then leads to considerable difficulties in the conventional constructions, since it is practically impossible in such a case to conduct a piecing operation automatically. If an automatic piecing step is to be carried out, a thread end to be wound off from the spool must be returned into the spinning turbine, attached to the fiber ring present therein, and then must be withdrawn again. However, this is impossible if the bobbin has already ejected and a new tube has been inserted, since this new tube does not have a thread which could be returned. In this case, it becomes necessary to conduct the piecing operation manually by operating personnel. Such manual piecing operations are connected with a considerable production loss. In the conventional types of structures, it is thus necessary to refine the mode of operation and make the mechanical construction so sophisticated that the danger of thread breaks during bobbin change is greatly reduced, even though it cannot be entirely avoided for the basic reasons set out above. Consequently, these devices require a complicated manufacture with a correspondingly high cost involved.

This invention is based in part on solving the problems of providing an apparatus of the type mentioned in the foregoing wherein the manufacturing expenditures are relatively low and yet the necessity of conducting manual operations is avoided with certainty. These problems are solved by preferred apparatus for preliminarily joining a thread section to a spool tube which is to replace a completed bobbin. This thread section is of a sufficient length to accommodate at least a one-time automatic piecing operation.

The above-noted preferred embodiments of the invention start with the consideration that the operating safety is increased by being able to conduct an automatic piecing operation at all times. The short-term loss of production by the arrest of the spinning station during the bobbin-change step does not result in an essential reduction in the degree of efficiency of the spinning station. On the other hand, the invention provides increased safety from disturbances which heretofore had to be eliminated by manual operations carried out by the operating personnel and consequently led to considerable outage times and impairments of the degree of efficiency.

Since it can happen under certain circumstances that an automatic piecing operation fails, so that it must be repeated, it is advantageous if the thread section or piece connected according to the invention with the tube to be inserted in the spinning station is wound about the tube in the form of a starting winding, wherein the latter is dimensioned so that it is long enough for a repeated piecing procedure. Even if the starting winding should have been used up by a larger number of failures during piecing, it is still unnecessary to carry out manual work, since in such a case the empty tube can be exchanged for a new one, which again carries a starting winding, so that more piecing attempts can be carried out. Since during the bobbin change, i.e. when the filled spool is exchanged against a tube provided with a thread end section, the spinning operation is interrupted, there is no need to consider the running spinning unit. The device of preferred embodiments of this invention can thus be realized by simple technical means.

To facilitate the further processing of the bobbin provided with a cop during the spinning process, it is provided to attach in or on the empty tube a thread reserve. Independently of whether the thread reserve is present in the form of a thread end in the tube bore or in the form of a starting winding on the tube, this thread reserve can already be used as the thread section for the piecing operation. However, it is especially advantageous and simple to provide the thread reserve in the form of a reserve winding on the tube, arranged outside of the spooling range. In this connection, the beginning of the thread should be positioned fixedly in the reserve winding so that it is accessible even after the bobbin has been finished.

To produce the thread section with the starting winding, a spooling device is provided which is arranged fixedly, preferably at a head end of the open-end spinning machine according to certain preferred embodiments of the invention. This spooling device is associated with a transfer unit for transferring the tube provided with the starting winding from the spooling device to the individual pirning stations, which transfer unit preferably includes a conveyor belt or a conveying box with corresponding loading and unloading devices.

Other preferred embodiments of the invention are contemplated wherein a spooling device is provided movable together with the bobbin changer; this spooling device providing a thread section forming a starting winding and optionally a thread reserve for the tubes to be transferred to the bobbin stand of the spinning station and having at least one auxiliary bobbin from which the thread is taken to form the starting winding.

In embodiments of spooling devices mounted to be stationary, as well as embodiments mounted to be mobile, the spooling device preferably includes thread guide means to establish a reserve winding on the tube laterally of the starting winding and also means to fix the beginning of the thread in position in the reserve winding. It is particularly advantageous to fix the beginning of the thread by overlapping during the formation of the reserve winding. For this purpose, the spooling device preferably comprises clamping means to clamp the thread in position at the end face of the spooling tube and for bending the beginning of the thread in a direction toward the reserve winding. An especially advantageous solution resides in that the clamping means for the tubes has a cap extending over the tube rim; which cap bends the beginning of the thread in the direction toward the reserve winding.

Particularly advantageous preferred embodiments, other servicing units are formed as a structural unit in combination with the bobbin changing apparatus. In such embodiments, for various servicing units, individual devices, such as, for example, the moving gear and the drive, need be present only in singular. Particularly preferred embodiments have the bobbin changing apparatus arranged above the other servicing units since in such a case different servicing operations can be executed simultaneously at the same spinning station, so that the outage time of this spinning station can be maintained at a relatively low value.

Especially advantageous further developments and embodiments of the invention are set forth in the following detailed description and the claims. In this context, one or the other of the solutions can be particularly suitable, depending on the structure of the machine or the construction of the manufacturing site where the machine is utilized. Additional features and advantages of the invention can be seen from the following description of the various preferred embodiments illustrated in the drawings.

BRIEF DESCRIPTION OF THE DRAWINGS

FIG. 5 schematically shows a detail of FIG. 2 on an enlarged scale;

FIGS. 6–9 show the detail of FIG. 5 in various operating positions;

FIGS. 18–22 show details of the spooling device of FIGS. 16 and 17 in various operating positions;

DETAILED DESCRIPTION OF THE DRAWINGS

Figure 1:
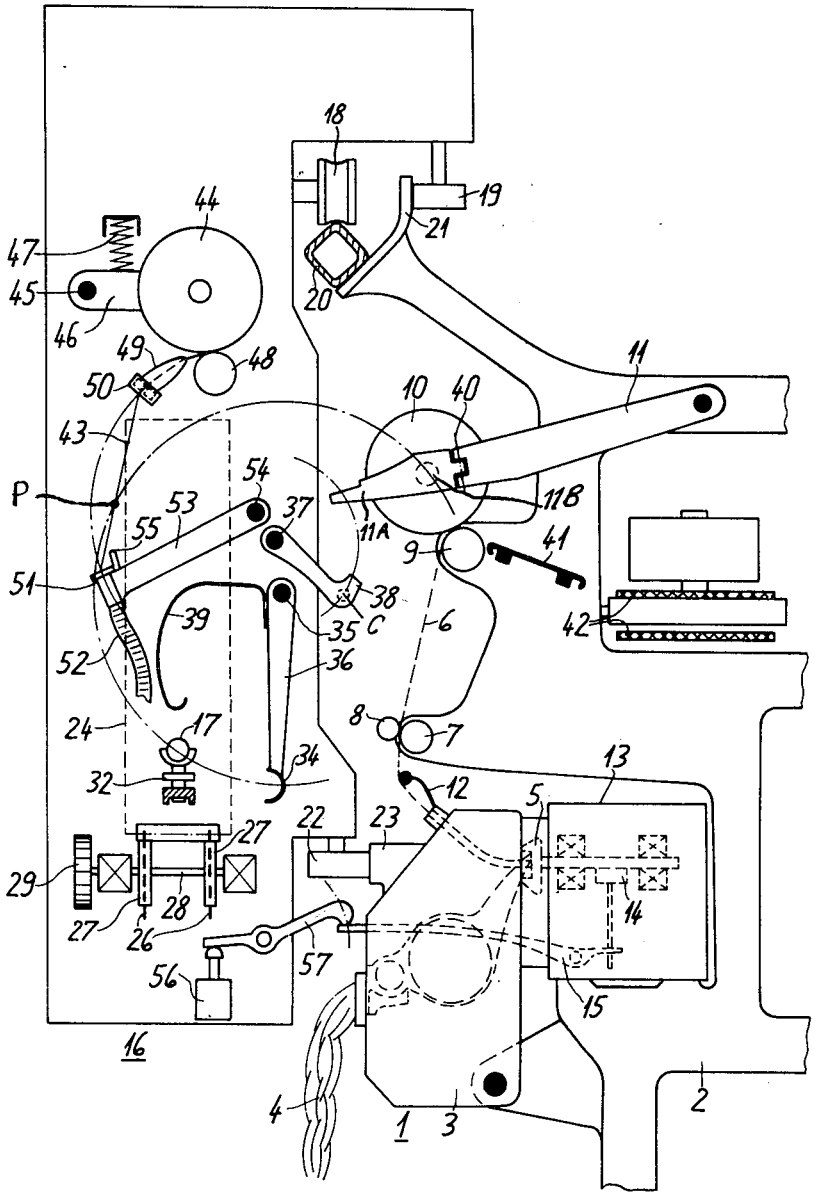
FIG. 1 is a vertical sectional schematic view of an open-end spinning machine in the zone of a spinning station with a bobbin changer constructed in accordance with a preferred embodiment of this invention disposed in this zone.

In the drawings, like reference numerals are used throughout the various views to designate like structure.

Figure 2:
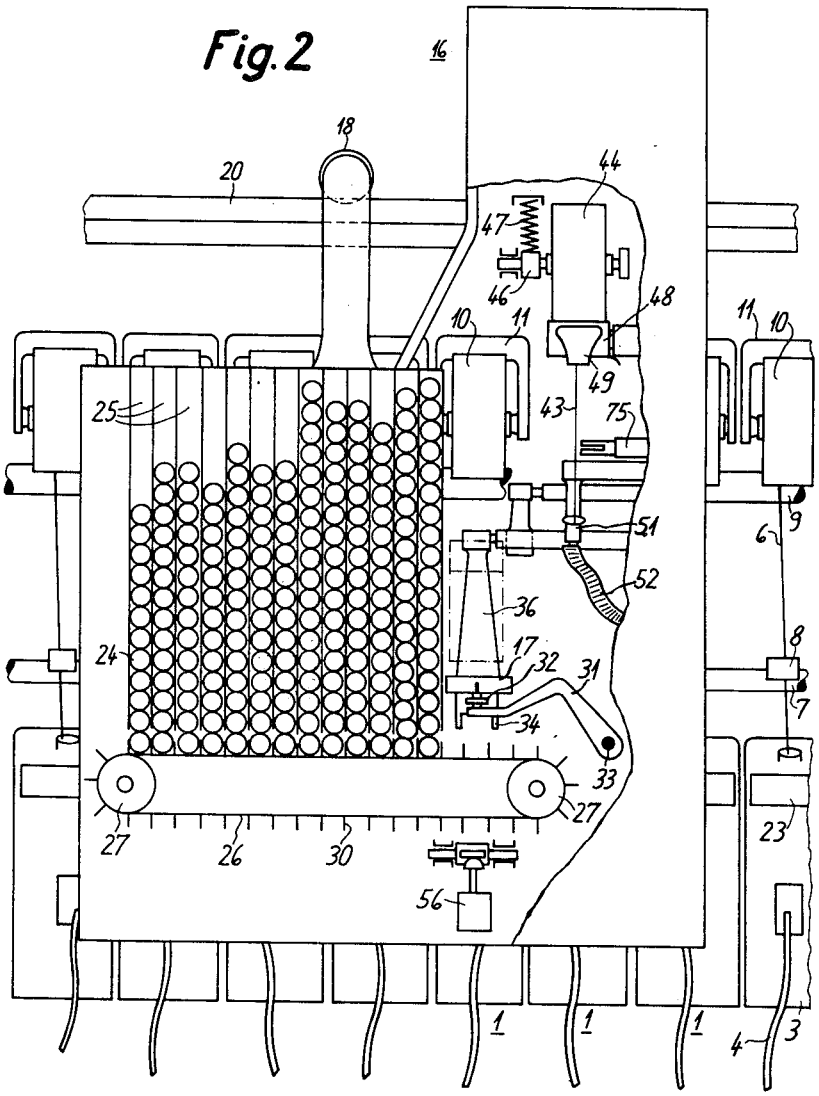
FIG. 2 is a front schematic view of FIG. 1, partially broken away.

The illustrated open-end spinning machine of FIGS. 1 and 2 includes a plurality of individual spinning stations 1 arranged side-by-side on both sides of a machine frame 2. In FIG. 1, only one side (left side) of the machine frame 2 and associated spinning stations is shown in order to more clearly depict the invention. Each spinning station comprises a feeding and opening device accommodated in a pivotable housing 3. This feeding and opening device breaks up a sliver 4 into individual fibers and feeds them to a spinning turbine 5, from where the spun thread 6 is then withdrawn by means of a pair of take-off rollers 7 and 8. The thread 6 is wound on a bobbin 10 which is supported in a bobbin disposed on a winding roll crell 11 and is on cylinder 9.

The presence of the thread 6 is monitored by a thread break sensor 12. Sensor 12 provides a signal for interrupting the feed of the silver 4 when the thread 6 is missing. The details of the mechanism for interrupting the feed of the silver 4 are not illustrated in detail herein, since known mechanisms can be used. For example, see U.S. Pat. No. 3,210,923.

The spinning turbine 5, disposed in its own housing 13, is provided with a brake 14 actuatable by way of a brake lever 15 projecting toward the outside from the housing 3. As can be seen from FIG. 2, common drive means are provided, preferably for all spinning stations 1, which common drive means are not interrupted or shut off even if one of the spinning stations 1 is arrested and ceases its spinning operation. For this purpose, the take-off roller 7 and the winding roll 9 are fashioned preferably as continuous shafts.

For the open-end spinning machine, a movable unit 16 is provided, by means of which a full bobbin 10 can be exchanged automatically for a spool tube 17, whenever necessary. In some embodiments the unit 16 is called, if required, to the respective spinning station 1. In other embodiments, the unit 16 detects the necessity for servicing (exchange of bobbin) by means of detectors when passing a spinning station. In other contemplated embodiments, the provision is made that the unit 16 proceeds stepwise from one spinning station to the next, effecting an exchange operation in each instance. This last-mentioned arrangement is particularly advantageous for machines operating such that one can assume that after a certain operation period an exchange of all bobbins 10 will be necessary. For accommodating movement, the unit 16 is equipped with a moving mechanism having two upper runners or rollers 18 and 19 moving on tracks 20 and 21 of the machine frame 2, these tracks being arranged above the spinning stations 1. Two or more runners or rollers 22 of the unit 16 are additionally supported on a guide rail 23 composed of individual sections attached to the housings 3 of the spinning stations 1. See commonly assigned U.S. patent application Ser. No. 633,807, filed Nov. 20, 1975, now U.S. Pat. No. 3,990,221, for disclosure of moving devices that could be used in conjunction with the present invention.

The unit 16 carries with it a plurality of spool tubes 17 in a magazine 24 which can be seen particularly from FIG. 2. This magazine 24, subdivided into individual wells 25, is in a zone of the unit moving past the spinning stations 1. In order to be able to accommodate a large number of spool tubes with a compact arrangement, the provision is made to fashion the wells 25 of the magazine 24 so that the spool tubes 17 are arranged with their axes at right angles to the traveling direction of unit 16 or to the longitudinal extension of the machine. The bottom of the magazine 24 contains two parallel-arranged conveyor chains 26, the sprocket wheels 27 of which are driven by way of a common shaft 28 by a drive mechanism 29 which is only cursorily illustrated. Dogs or entrainment means 30 project at regular intervals from the chains 26; the spacing of these dogs corresponding approximately to the diameter of the spool tubes 17, so that respectively one spool tube 17 lies in a compartment formed in this way. The drive mechanism 29 is advanced in a rhythmic stepwise fashion so that respectively one of the spool tubes 17 is moved from the magazine into the range of an extractor 31.

The extractor 31 engages between the two chains 26 and lifts a spool tube 17 out therefrom. The extractor has a rotating mechanism 32 which rotates the respective spool tube by 90°. In this connection, the pivotal motion of the extractor 31, pivotable about an axle 33, is preferably transmitted by way of a chain or a studded belt or the like to the rotating mechanism 32, so that only one drive unit is required for pivoting of extractor 31 and rotation of mechanism 32.

Figure 1A:
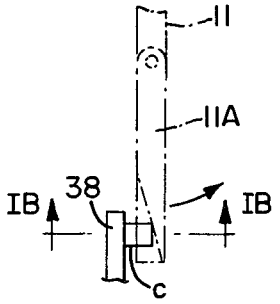
FIG. 1A is a schematic enlarged partial view, taken from above in FIG. 1, and showing the cooperation of certain parts.
Figure 1B:
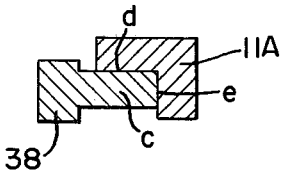
FIG. 1B is a schematic enlarged partial view taken along section IB—IB of FIG. 1A.

The extractor 31 offers the spool tube 17 to a gripper 34 arranged at the end of an arm 36, which latter is swingable about an axle 35. The axle 35 is arranged in parallel to the axis of the spool tube 17 which at this point is already aligned in the position wherein it is to be inserted in the bobbin creel 11. This inserting step takes place with the aid of the gripper 34 which is pivotable up to the bobbin creel 11. Previous to the inserting step, the bobbin 10 must be removed and ejected toward the center of the open-end spinning machine. For this removal and ejection of bobbin 10, the bobbin creel 11 is lifted with the aid of a lever 38 pivotable about an axle 37, so that the bobbin 10 is no longer driven by the winding roll 9. The bobbin 10 is then ejected by an ejector plate 39 attached to the swivel arm 36 of the gripper 34 as the arm 36 is pivotally moved from the position shown in FIG. 1 toward a position to insert tube 17 in creel 11. The lever 38 spreads beforehand the front ends 11A of the bobbin creel 11 about joints 40 (spring biased) to such an extent that the tube of bobbin 10 comes out of engagement with the bearing pins 11B of the bobbin creel 11, 11A. Enlarged schematic views of FIG. 1A and 1C more clearly illustrate an exemplary arrangement of the cooperation of cam C carried by swivel arm 38 and the cooperating cam surfaces *d* and *e* of creel part 11A whereby the lifting and spreading of creel parts 11A is accomplished. The bobbin 10 then moves over a plate 41 toward the center of the machine frame 2, where it falls onto a conveyor belt 42 from where it is further conveyed. The gripper 34 transfers the spool tube 17 to the bobbin creel 11, the swivel arm 38 then moving back so that the spool tube 17 engages the bearing pins 11B of the creel 11, 11A.

However, before the spool tube 17 is introduced into the bobbin creel 11, it is joined to a thread 43 withdrawn from an auxiliary bobbin 44. The auxiliary bobbin 44 of the unit 16, which carries windings of a yarn of the same quality as is to be produced by the spinning means 1, is mounted about an axle 45 with a swivel arm 46, the latter being under the effect of a compression spring 47. The compression spring 47 presses the auxiliary bobbin 44 against a drive roller 48, by means of which the auxiliary bobbin 44 can be driven in the unwinding direction.

A guide element 49 is directed toward the auxiliary bobbin 44; this guide element has the form of a flattened funnel and serves for withdrawing the thread 43 therethrough. The outlet of the guide element 49 is provided with a thread gripper 50 exerting a slight pressure on the thread 43 and preventing an unintended retraction of the thread 43. A take-off means is associated with the guide element 49. In the illustrated embodiment, this take-off means is a suction nozzle 51 connection via a flexible hose 52 to a vacuum source, not shown. The suction nozzle 51 is arranged on a swivel arm 53 pivotable about an axle 54 in parallel to the axle 35 of the gripper 34. With the aid of the take-off means fashioned as a sunction nozzle 51, the thread 43 is withdrawn from the auxiliary bobbin 44 and stretched in a zone past which the spool tube 17 is being moved. As can be seen particularly from FIG. 1, the travel path of the tube intersects, in the view of FIG. 1, the tensioned thread 43 at a socalled point of intersection P. However, the spool tube 17 is guided with the gripper 34 laterally of the thread 43 past the latter.

In the zone of the aforementioned "point of intersection," P an auxiliary device 75 (see FIG. 2 and 5 to 9) for unit 16 is arranged for establishing a connection of a thread section from thread 43 and the spool tube 17. The auxiliary device 75 does not only establish a connection of the thread 43 with the spool tube 17, but furthermore also produces a thread reserve which is placed, preferably, into the interior of the spool tube 17. For this purpose device 75 includes an extension having the shape of teeth or tines, movable into the direction of the travel path of the thread 43 for seizing the thread 43 and generates a thread reserve by winding same onto the tines; the length of thread required for this purpose being wound off from the auxiliary bobbin 44. This tooth- or fork-shaped extension of the auxiliary device 75 is then shifted further axially into the tube 17, where the thread windings are stripped off by an additional stripping element movable axially with respect to the extension. The auxiliary device 75 and its function will be explained in greater detail below in connection with FIGS. 5 to 9. The tube 17, which then is moved on to the bobbin creel 11 by gripper 34, draws thread off the auxiliary bobbin 44. After the tube has been clamped into the bobbin creel 11, it contacts the winding roll 9, by means of which the tube is driven. This drive is maintained over a predetermined time period so that a sufficient starting winding is applied to the tube 17 with the aid of the thread 43 taken off from the auxiliary bobbin 44. During the entire time, the take-off means 51 retains the thread end while the amount of thread required for the thread reserve and the starting winding is withdrawn from the auxiliary bobbin 44 or is unwound by way of the unwinding roll 48. After a predetermined number of revolutions, the take-off means 51 is moved to the guide element 49; during the procedure, a knife 55 attached to the taken-off means servers the thread, so that the starting winding of the spool tube 17 disposed on the winding roll 9 of the spinning unit 1 is terminated. The take-off means 51 then returns into its illustrated position and again stretches a thread 43.

Before the spool tube 17 replaces the bobbin 10, the spinning step of the respective spinning station 1 is interrupted. For this purpose, the unit 16 is equipped with a mechanism effecting this interruption. In the illustrated embodiment, a solenoid (lifting magnet) 56 is provided which can adjust the brake lever 15 of the respective spinning station 1 by way of a lever 57, thus actuating the turbine brake 14 by means of this brake lever 15. Thereby, the thread 6 is severed, so that also the fiber feed, controlled by the thread monitoring sensor 12, is interrupted in some other way according to other contemplated embodiments. For example, the process can be interrupted by adjusting the thread monitor sensor 12 or by simply cutting the spun thread 6. It is also contemplated to interrupt the spinning procedure automatically once the bobbin has been filled. The unit 16 is then called to the respective spinning station 1. It is sufficient if the interruption of the spinning process takes place only immediately before the actual ejection of the bobbin 10, i.e. when the bobbin creel 11 is lifted, so that the drive of the bobbin 10 is interrupted. The unit 16, at this point in time, can already hold the gripper 34 with the spool tube 17 and the ejector plate 39 in the direct vicinity of the bobbin creel 11, so that there is no necessity for long downtimes to occur. The preparation work, i.e. the withdrawal of the spool tube 17 from the magazine 24, the rotating of tube 17, the conveying of tube 17 into the upper zone, and the application of a thread reserve, can be readily executed beforehand, for example during the time in which the unit 16 moves from one spinning station 1 to the next. If, then, a piecing device follows the unit 16 directly, which device executes a piecing operation immediately after the exchange of the bobbin 10 for the spool tube 17 at the respective spinning station, the downtime caused by the bobbin change is very brief. In any event, a total outage of the respective spinning station, which could necessitate a manual operation, is safely prevented.

Advantageously, the mobile unit is combined with a further servicing device, for example a cleaner or a piecing mechanism, since in such a case certain parts, especially the drive for the moving mechanism and the latter itself are only required once. If these parts are to be combined with a piecing mechanism, it is advantageous to dispose this piecing mechanism so that it is offset with respect to the unit 16 by the subdivision of the machine or a multiple thereof, i.e. by the mutual spacing of the spinning stations 1, since in this case two spinning stations 1 can be worked on simultaneously. However, if the unit 16 combined with a cleaning device according to certain preferred embodiments of the invention, it is readily possible to have the two mechanisms work on one spinning station 1 simultaneously. Such an arrangement is shown in FIG. 3.

Figure 3A:
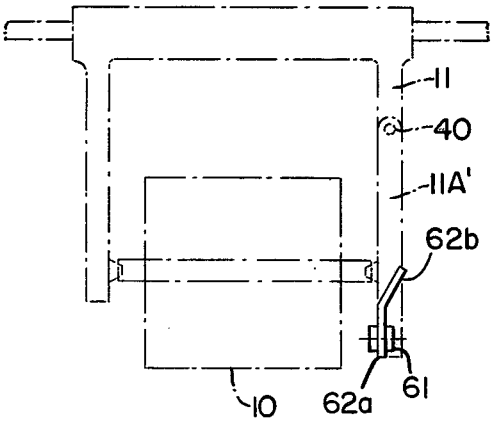
FIG. 3A is an enlarged schematic partial view showing a detail of the preferred embodiment of FIG. 3.
Figure 3B:
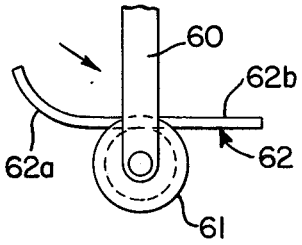
FIG. 3B is a schematic partial view, taken in the direction of arrow 3B of FIG. 3A.
Figure 3C:
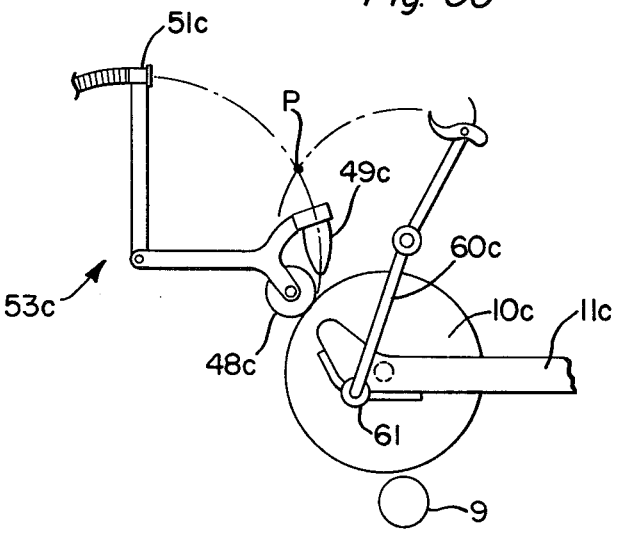
FIG. 3C is an enlarged schematic partial view depicting a modified embodiment, similar to the FIG. 3 embodiment, but with the starter winding thread being supplied by the previously filled bobbin.
Figure 3:
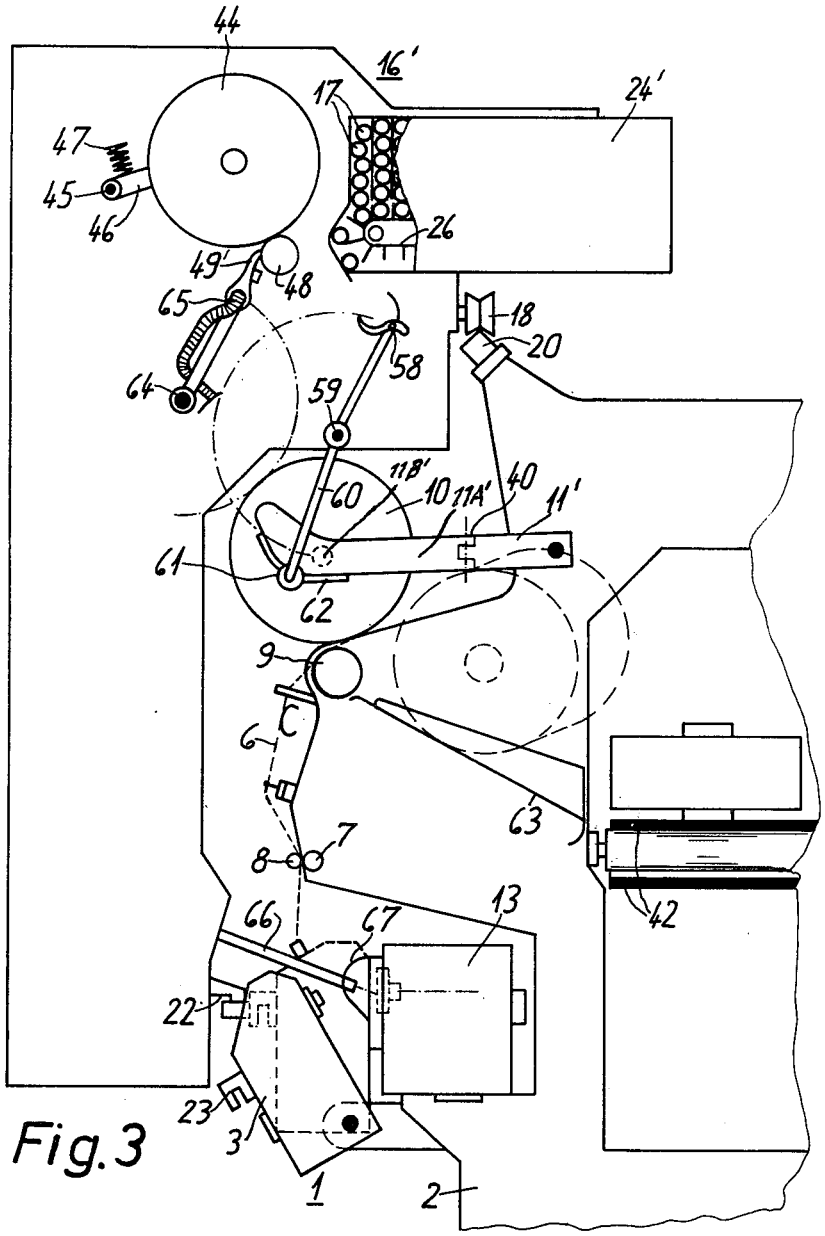
FIG. 3 is a vertical sectional schematic view of an open-end spinning machine with another embodiment of a bobbin changer and an additional servicing unit constructed in accordance with the present invention.

In the embodiment of FIG. 3, unit 16' is so disposed and constructed that it is utilized simultaneously with a cleaning device at the same spinning station 1. The parts necessary for exchanging the bobbin 10 for a spool tube 17 are located in the zone above the actual spinning stations 1, while the parts of the cleaning device are disposed in the zone in front of the spinning stations 1. In this embodiment, magazine 24' is above the machine frame 2, i.e. in a heretofore unused area, where even a large-volume system is not troublesome. The spool tubes 17 thus can be accommodated in the magazine 24' so that they are already properly axially aligned or oriented. Also in this embodiment, two conveyor chains 26 are provided in the bottom zone of the magazine; these chains being fashioned in correspondence with FIGS. 1 and 2. The conveyor chains 26 transfer, in this arrangement, the spool tubes 17 directly to a gripper 58, the end of which can be opened and closed like tongs in a manner not shown in detail, so that the spool tubes 17 are thereby safely seized and clamped in position. This gripper 58, which is pivotable about an axle 59, inserts the spool tube 17 directly into the bobbin creel 11'. The bobbin creel 11' is lifted and end portions 11A' spread apart by means of an adjusting lever 60 pivotable about the same axle 59; which adjusting lever carries a guide roller 61 at its free end. The guide roller 61 is associated with a guide element 62 of the bobbin creel 11', which element extends approximately horizontally in the zone underneath the middle of the bobbin 10 in the illustrated embodiment and points obliquely toward the inside, so that the outer portion of the bobbin creel is spread toward the outside by the incoming guide roller 61. Enlarged schematic views of FIGS. 3A and 3B more clearly illustrate the cooperation of guide roller 61 with guide element 62 of the bobbin creel, whereby it can be seen that roller 61 effects a lifting action as it travels along portion **62*a* and a spreading action as it travels along portion 62*b* of guide element 62. Thereafter, the bobbin 10 falls onto a deflector plate 63 which is fashioned so that the bobbin falling onto the plate is turned and then stands with its tube on the conveyor belt 42**.

Also the auxiliary bobbin 44 as well as its unwinding roll 48 and guide element 49' are located in the zone above the bobbin 10. The guide element 49' is associated with a take-off means 65 pivotable about an axle 64 and operating with suction air; this take-off means is pivoted past a lateral opening of the guide element 49'; severing the thread to be taken off from the auxiliary bobbin 44 during this process by means of a blade-like edge. Also in this embodiment, a connection is established between the spool tube 17 and a thread stretched between the auxiliary bobbin 44 and the take-off means 65. Suitably, here again an auxiliary mechanism such as shown in FIGS. 5 to 9 is utilized which not only fixes the thread in position at the spool tube 17 but also applies a thread reserve.

The unit 16' is combined with a cleaning device, of which only a cleaning nozzle 66 is shown; which nozzle shields, with a cup or dome 67 the housing surrounding the spinning turbine 5 and penetrates with a brusk-like element or the like into the spinning turbine 5. For this purpose, the housing 3 is pivoted away about an axle 68, which is effected automatically by means of an auxiliary mechanism, not shown, pertaining to the cleaning device. This pivoting of the housing 3 results in an interruption of the spinning process of the respective spinning station 1, so that an additional means for effecting the interruption is not required. See copending commonly assigned U.S. application Ser. No. 510,564 filed Sept. 30, 1944, now U.S. Pat. No. 3,950,926, for disclosures of cleaning device apparatus that could be used with the present invention. The system illustrated in FIG. 3 can also form a structural unit with a piecing device, which is arranged to be offset with respect to the two above devices by at least the subdivision of the machine, so that it can, for example, service the spinning station where immediately previously a bobbin change and a cleaning step had been performed. See commonly assigned U.S. Pat. Nos. 3,924,393; 3,924,394 and 3,925,975 for disclosures of piecing devices.

Figure 4:
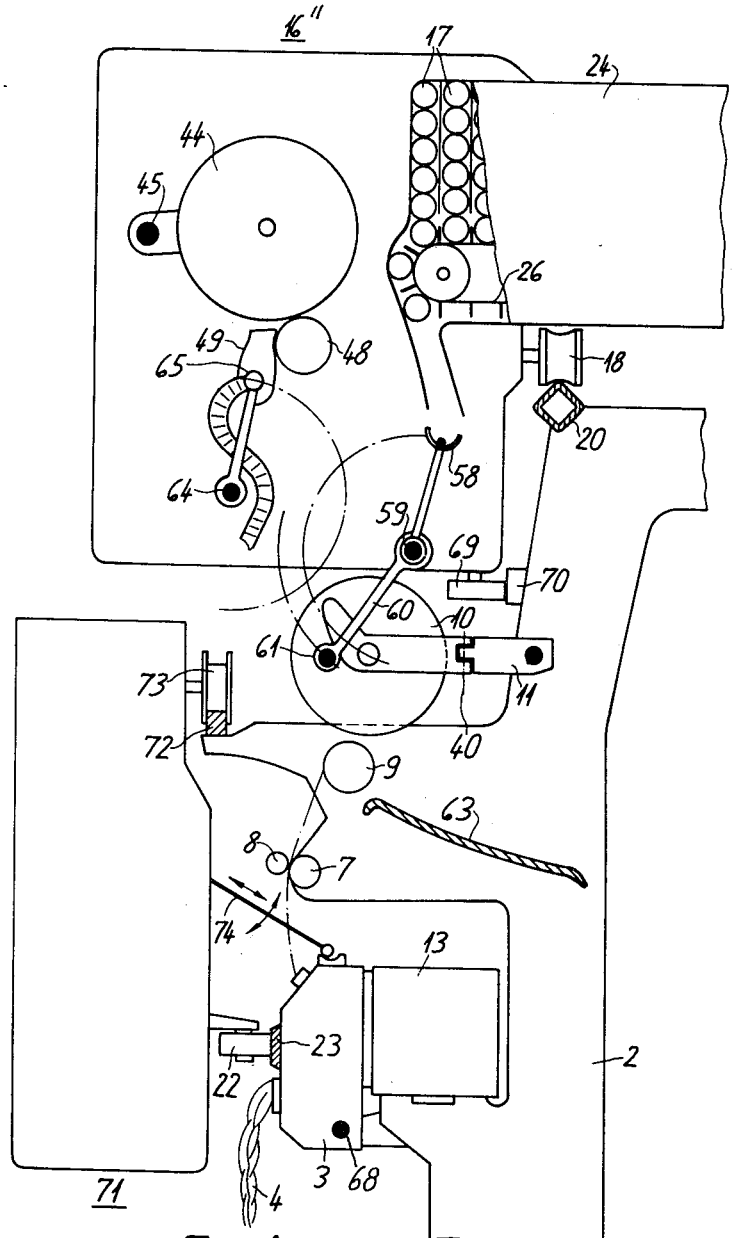
FIG. 4 is a vertical sectional schematic view of an open-end spinning machine with a further embodiment of a bobbin changer and an additional servicing unit constructed in accordance with the present invention.

The embodiment of FIG. 4 corresponds in its basic structure regarding the bobbin change to the embodiment of FIG. 3. The unit 16" has its own driving mechanism, comprising rollers 18 running on tracks 20 and further rollers 69 and tracks 70. A device 71 is provided independently of the unit 16 and movable along a separate track and with a separate driving mechanism; this device 71 contains a further servicing unit, for example, a piecing device or a cleaning device. This device 71 comprises, in addition to the runners 22 running along the rails 23 consisting of sections, runners 73 which are guided on a rail 72. The device 71 is provided with a mechanism 74 movable in correspondence with the double arrows illustrated in FIG. 4 and thus capable of opening the housing 3 of the spinning station 1 so that the spinning process is interrupted. See commonly assigned copending U.S. patent application Ser. No. 633,807, field Nov. 20, 1975, for further disclosure of mobile servicing device details of the type schematically depicted by reference numeral 71.

Figure 15:
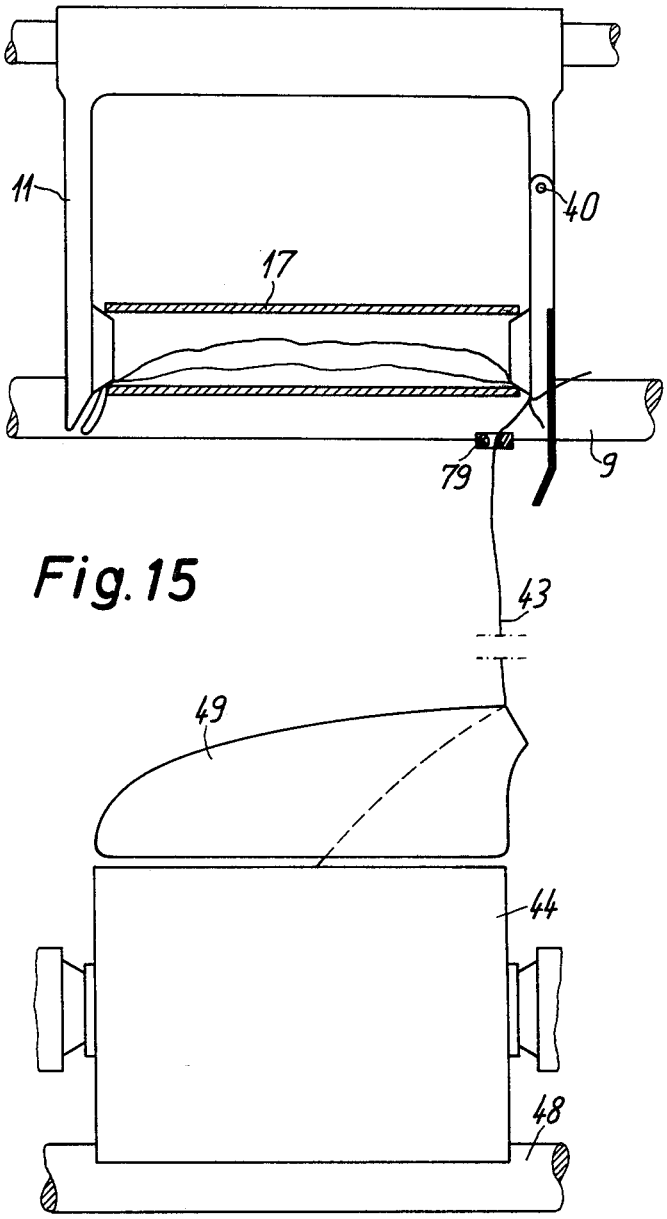
FIG. 15 is an illustration on an enlarged scale schematically depicting the formation of a starting winding on a tube.

The auxiliary device 75 already mentioned in connection with FIG. 2 is shown in greater detail in FIGS. 5 to 9 with regard to its construction and function. This device has two parts 76 and 77, opposing each other in the manner of tines, which receive the thread 43 between them by combined axial shifting and then can wind the thread around themselves by rotating together, as illustrated in FIGS. 5 and 6. The spool tube 17 to be provided with a thread reserve is then brought into a position coaxial with respect to parts 76 and 77, whereupon the two parts 76 and 77 are axially moved into the spool tube 17 together with the thread 43 wound thereon (FIG. 7). Thereafter, the part 77, provided with a stripping means 78, is shifted still further into the spool tube 17, entraining the wound-up thread. Subsequently, both parts 76 and 77 are again retracted, so that a thread reserve has been deposited in the spool tube 17. The spool tube 17 is thereafter transferred to the bobbin creel 11, as illustrated, for example, in FIG. 15. During this step, the thread 43 is clamped by the bobbin creel against the rim of the tube, so that a firm connection is established and the windup can be executed without any problems. The thread 43 is furthermore inserted in a traversing mechanism 79 (FIG. 15) taking care of the desired course of the starting winding.

Figure 10:
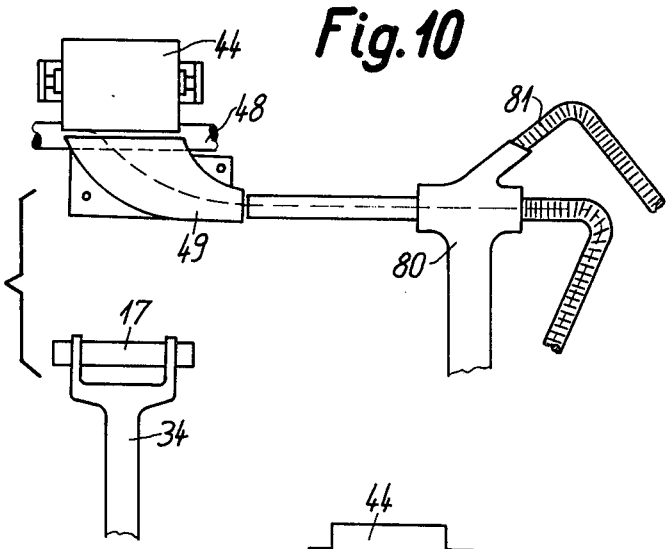
FIGS. 10–12 show another embodiment of a detail in various operating positions.
Figure 11:
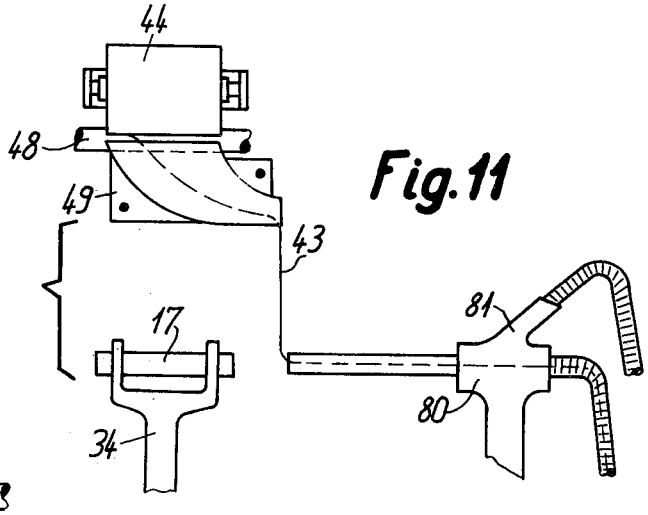
Figure 12:
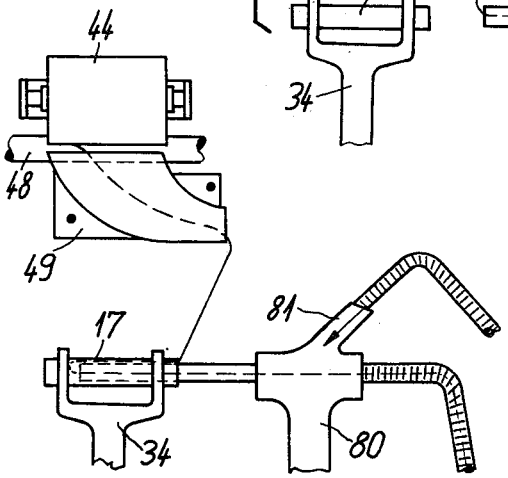

FIGS. 10 to 12 show details of preferred embodiments which do not require an additional, auxiliary device with the take-off means appropriately constructed. The take-off means 80 illustrated in FIGS. 10 to 12 is a suction nozzle which can be connected to the guide element 49 and sucks in the thread wound off from the auxiliary bobbin 44. This suction nozzle is then movable into a position wherein it is coaxial to the spool tube 17 located in the gripper 34. As shown in FIG. 12, the suction nozzle can then additionally be moved axially, so that it penetraates into the spool tube. A compressed-air conduit 81 is furthermore connected to the suction nozzle 80; this conduit is in communication, in a manner nor shown in detail, with a source of compressed air and can be supplied, for short periods of time, with compressed air. It is thereby possible to blow out at least a portion of the sucked-in thread from the take-off means, which latter is actually fashioned as a suction nozzle, and deposit this thread in the spool tube 17. This thread can then assume the position in accordance with FIG. 15. In the embodiments of FIGS. 5 to 12, care must be taken that the unwinding from the auxiliary bobbin takes place satisfactorily during the further movement and transfer of the tube to the bobbin creel, so that the thread is not pulled out of the tube and the thread reserve is thus destroyed.

Figure 13:
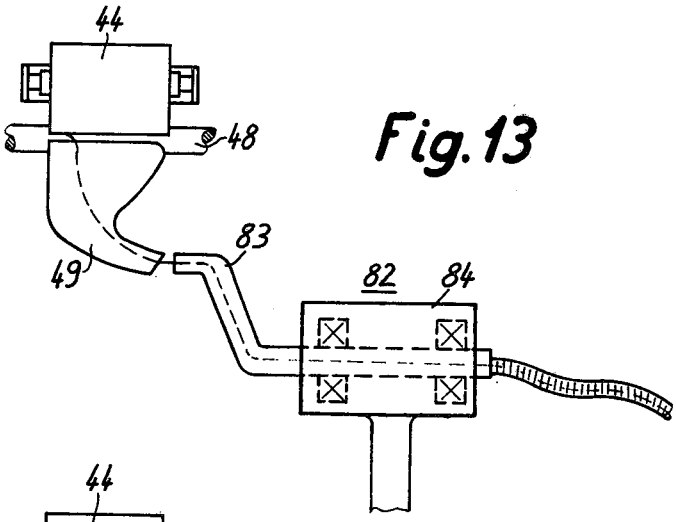
FIGS. 13 and 14 show a further embodiment of a detail in two different operating positions.
Figure 14:
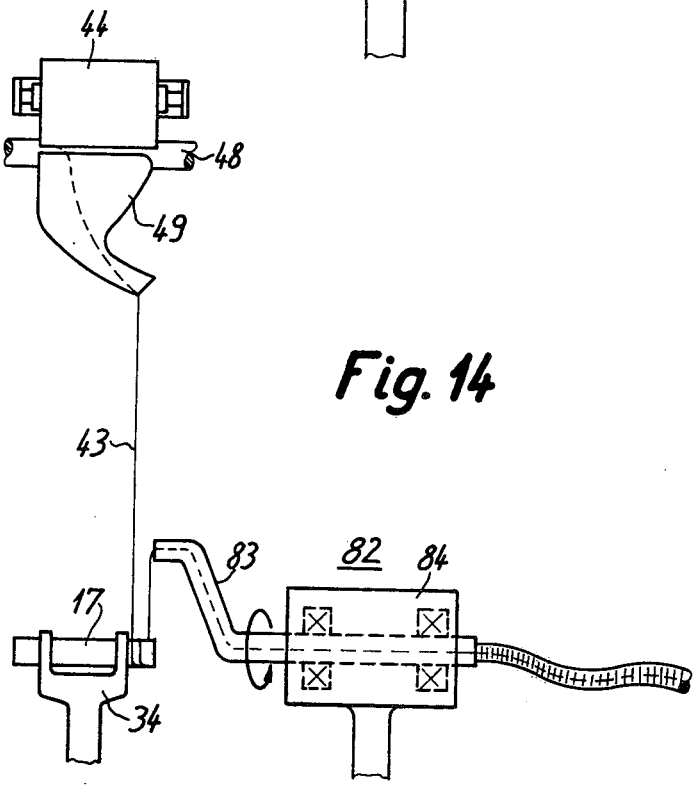

FIGS. 13 and 14 likewise show an embodiment wherein there is no need for providing an auxiliary device for joining the thread 43 to the spool tube and for the simultaneous application of a thread reserve, since the take-off means 82 takes over this function as well. The take-off means 82 contains a suction nozzle 83 which can be oriented toward the mouth of a guide element 49. The take-off means 82 can be moved away from the guide element for tensioning a thread 43; a certain thread section is thus sucked into the suction nozzle 83. Here again, similarly as in the other embodiments, the spool tube 17 can be brought into the range of the stretched thread 43 by means of a gripper 34. The take-off nozzle 83 has a rotary drive mechanism, and for this purpose the nozzle is connected, for example, with the rotor of an electric motor 84, which latter is indicated merely schematically. This rotary drive mechanism moves the take-off nozzle 83 so that its mouth travels around the spool tube 17 along a circular path. For this purpose, the take-off nozzle 83 is bent about its region which can be adjusted coaxially to the spool tube 17 and is connected to the electric motor 84. The rotation of the take-off nozzle 83 about the spool tube 17 produces a thread reserve, since during this step the length of thread previously sucked into the take-off nozzle 83 is wound onto the spool tube 17. During this winding operation, no thread is supplied by the auxiliary bobbin 44. After the thread reserve has been applied, the spool tube 17 is inserted in the bobbin creel in one of the ways described hereinabove, and thread is supplied by the auxiliary bobbin 44. Thereafter, the tube 17 is placed on the winding roll 9 pertaining to the spinning station, so that the starting winding necessary for the piecing operation is applied to the tube. This starting winding and also the subsequent lap are suitably applied so that the thread reserve wound onto the tube in the marginal zone thereof is at least partially covered by windings and thus the thread reserve is sufficiently fixed in position.

It is also contemplated, in a supplementation of FIGS. 13 and 14, to provide a winding mechanism by means of which the starting winding is applied to the tube 17 still outside of the range of the spinning unit, by associating the spool tube 17 with a winding device of the mobile unit 16, which applies the starting winding while winding the thread 43 thereon.

In a deviation from the heretofore described embodiments, it is contemplated to make do without an auxiliary bobbin and take the thread required for the formation of the thread reserve and the starting winding from the bobbin 10 produced at the respective spinning station to be serviced. FIG. 3C illustrates such an embodiment, which involves an alteration of the FIG. 3 embodiment and therefore the same reference numerals with the suffix C are used to depict corresponding parts of the FIG. 3 embodiment. In these embodiments, a device is provided which lifts the bobbin 10C off the winding roll 9. This bobbin is then associated with an unwinding roll 48C and with a thread guide element 49C, which parts would then have to mounted at the unit to be movable. This embodiment would have the advantage that it would be impossible to choose by error the wrong-gauge yarn for the thread used in producing the starting winding and the thread reserve. In such a case, the unwinding roll 48C and the guide element 49C would be arranged to be pivotable about the same axis as the take-off means, so that no adjustment difficulties would have to be expected in this direction.

By the provision of a starting winding on a spool tube 17 to be exchanged for a bobbin 10, the advantage is furthermore attained that during a subsequent piecing step a cumbersome searching for the thread end is eliminated. Since all spool tubes 17 used for the exchange are provided with a corresponding starting winding, the thread end is located in a quite specific predetermined zone so that the intake nozzle customarily present in a piecing device would not have to extend over the entire range of the spool tube. Besides it is possible to deposit the thread end, during the exchange of the bobbin 10 for a spool tube with a starting winding, at a specific location, for example, in the traversing mechanism 79 which is arrested at a quite specific point, so that the thread end can be easily found by the piecing device.

Figure 16:
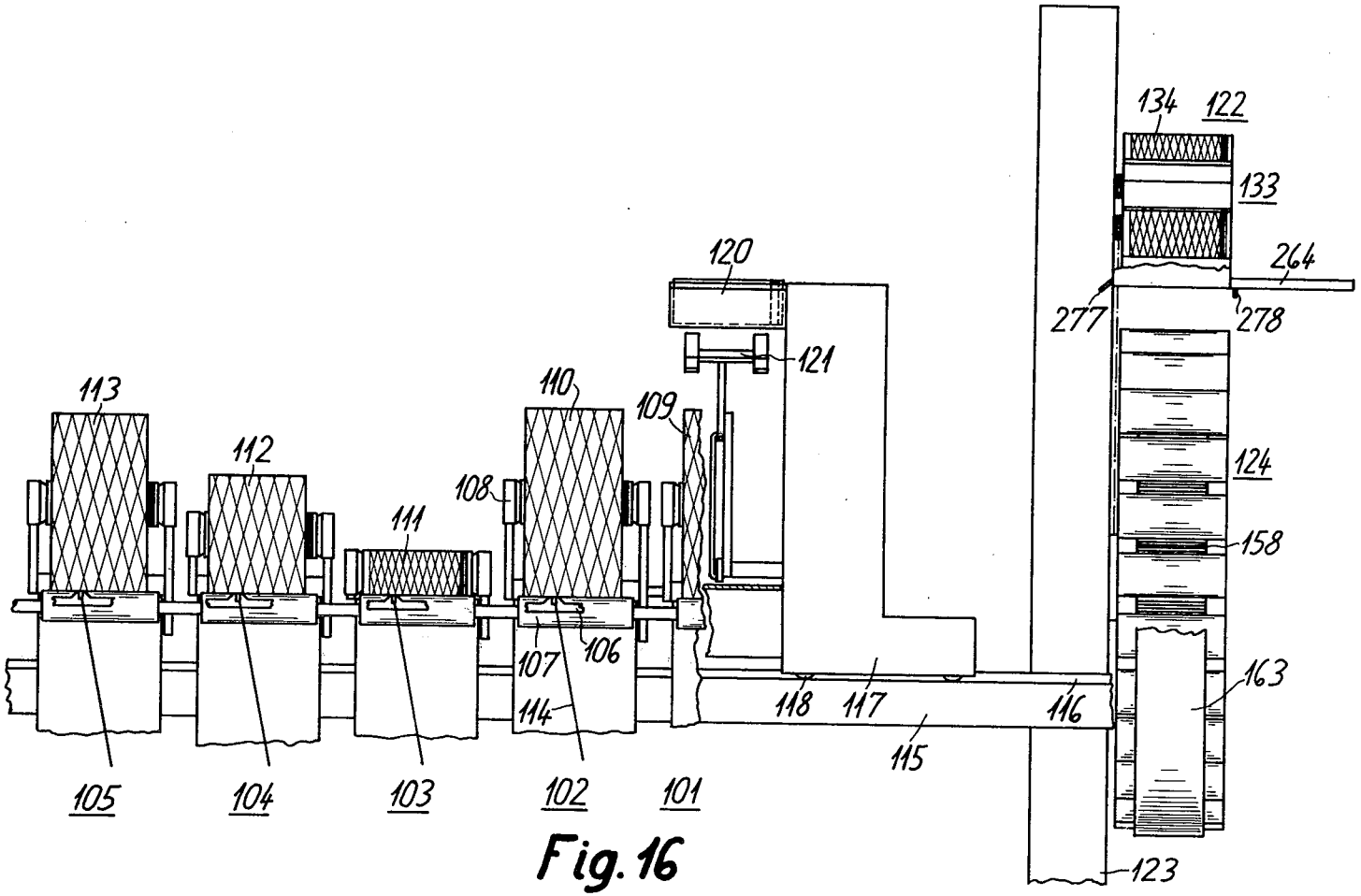
FIG. 16 is a simplified lateral schematic view of another spinning machine with several spooling stations, a movable winding spool changing device, and a special spooling device for the production of spooling tubes provided with a thread reserve and starting winding according to another embodiment of the present invention.

The spinning machine illustrated only in a fragmentary view in FIG. 16 comprises a plurality of individual spinning stations with spooling stations associated therewith, of which merely the spooling stations 101–105 are visible. Each spooling station has a reciprocating thread guide 106, a winding shaft 107, and a bobbin creel 108 in which are inserted winding spools 109–113 of different-sized cops. By rolling along the winding roll 107, the winding spools are set into rotation, and thus the thread 114 is wound up. Furthermore illustrated are a machine frame 115 and a rail 116 on which a winding spool changing device 117 is movable by means of the rollers 118 and 119.

A magazine 120 and a tube feeder 121 are arranged on the winding spool changing device 117. At the end of the spinning machine, a special spooling device 122 is disposed, the details of which can be seen especially from FIG. 17. The associated machine frame 123, a rotatable tube magazine 124, a delivery spool or auxiliary spool 125, a thread brake 126, a pivotable thread guide plate 127, a winding roll 128, a pivotable thread gripper cutter 129, a pivotable tube creel 130 with a spool tube 131 clamped therein, a pivotable tube gripper 132, and a magazine 133 for the spool tubes 134 already provided with a starting winding and a thread reserve are furthermore illustrated. Parts 124–133 are joined to the machine frame 123. Additional details of the spooling device 122 are shown in FIGS. 18 to 22.

The magazine 133 contains an endless conveyor belt 136 which is guided by a roller 137 and driven by a roller 138. Identical tube pockets 139, 140, and 141 are disposed on the conveyor belt 136 for receiving the spool tubes 134 already provided with a starting winding and with a thread reserve.

By means of a sprocket wheel 143 laterally mounted to the roller 138, the conveyor belt 136 is moved stepwise in the direction of the arrow 142. By means of a deflector plate 145 attached by the fishplate 144 to the machine frame 123 and by means of a slide 146, the spool tubes are secured against falling out of the magazine 133.

Figure 17:
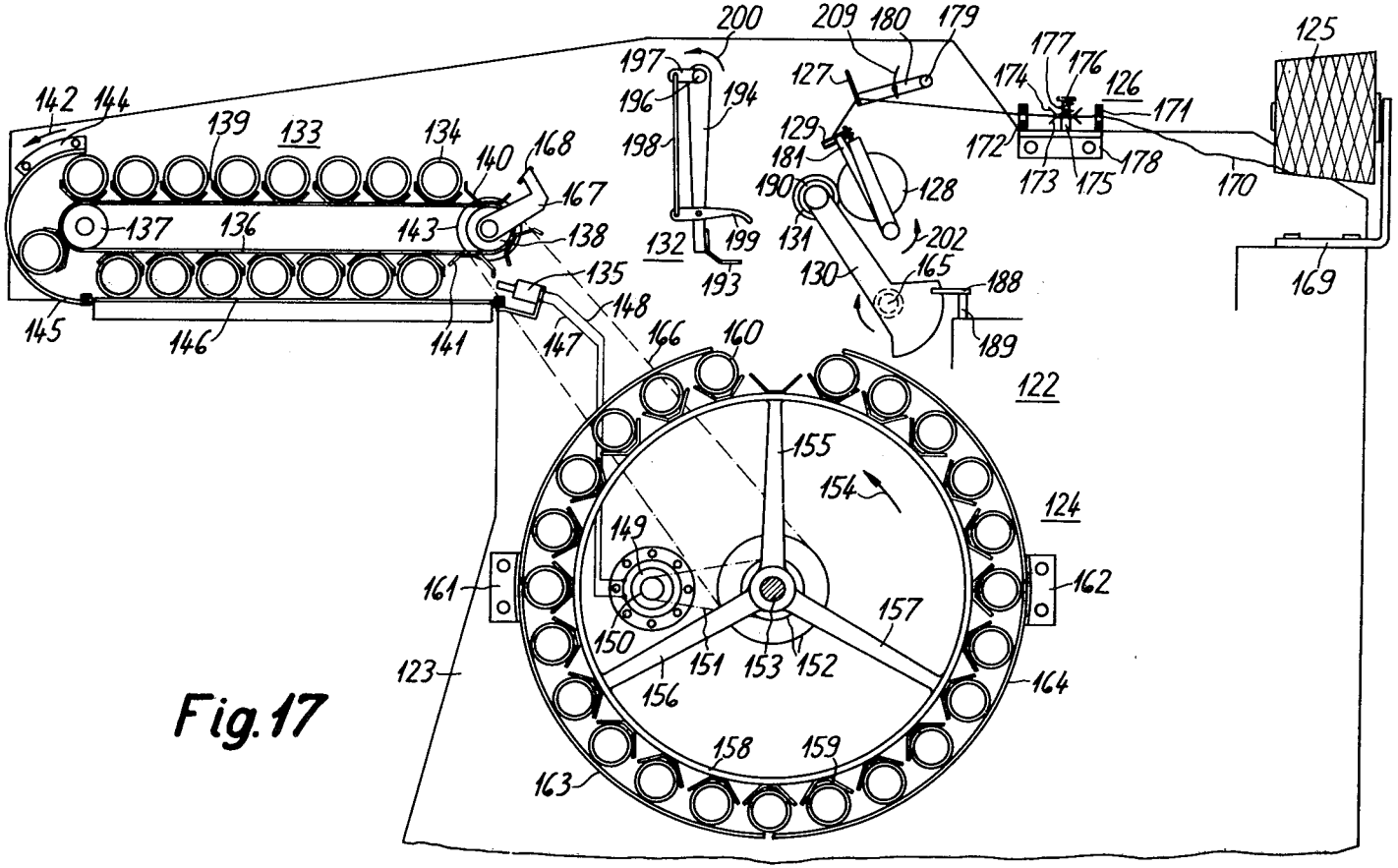
FIG. 17 is a simplified lateral schematic view of the spooling device according to FIG. 16.

As soon as the sensor 135, shown in FIG. 17, has found, for example by feeling or by photoelectric methods, that there is no spool tube present in the tube pocket 141 presently in front of this sensor, steps are taken for automatically preparing and supplying a spool tube provided with a starting winding and a thread reserve. For this purpose, the sensor 135 transmits via lines 147, 148 a starting signal to a motor 149. The sprocket wheel 150 attached to the motor shaft thereupon drives a chain 151 which rotates the twin sprocket wheel 152 attached to the shaft 153 of the tube magazine 124 in the direction of arrow 154. Three spokes 155, 156, and 157, likewise joined to the shaft 153, carry a circular hoop 158 to which are mounted identical tube pockets 159 arranged at equal intervals. Empty spool tubes 160 are inserted in the tube pockets and are secured against falling out by guide plates 163, 164 attached with fishplates 161, 162 to the machine frame 123. With each switching step, the tube magazine 124 is further rotated by 1/24 of its circumference, and thus respectively one spool tube is brought into the uppermost position, from which, according to FIG. 17, the tube creel 130 pivotable about the axle 165 has already withdrawn the corresponding spool tube 131.

Upon a further rotation of the tube magazine 124, the sprocket wheel 143 and thus also the conveyor belt 136 are rotated by means of the chain 166 by one pocket division, so that in this case respectively one empty tube pocket 140 is disposed on the left-hand side of the transfer surface 168 carried by the holder 167. The winding up on the spool tube 131 and the insertion of this tube in the empty tube pocket 140 of the magazine 133 are effected as follows:

A textile thread 170 runs from the delivery spool 125, carried by a holder 169 joined to the machine frame 123, via the thread brake 126 and the thread guide plate 127 to the thread gripper cutter 129 which retains the thread end. The thread brake 126 consists of two thread guides 171, 172 and two movable disks 173, 174 placed on a mandrel 175 and being under the bias of a spring 177; the latter can be adjusted by means of the setscrew 176. Parts 171, 172, and 175 are held by a bracket 178 attached to the machine frame 123. The thread guide plate 127 is held by a lever 180 rotatably attached to the machine frame 123 by means of the shaft 179.

Figure 18:
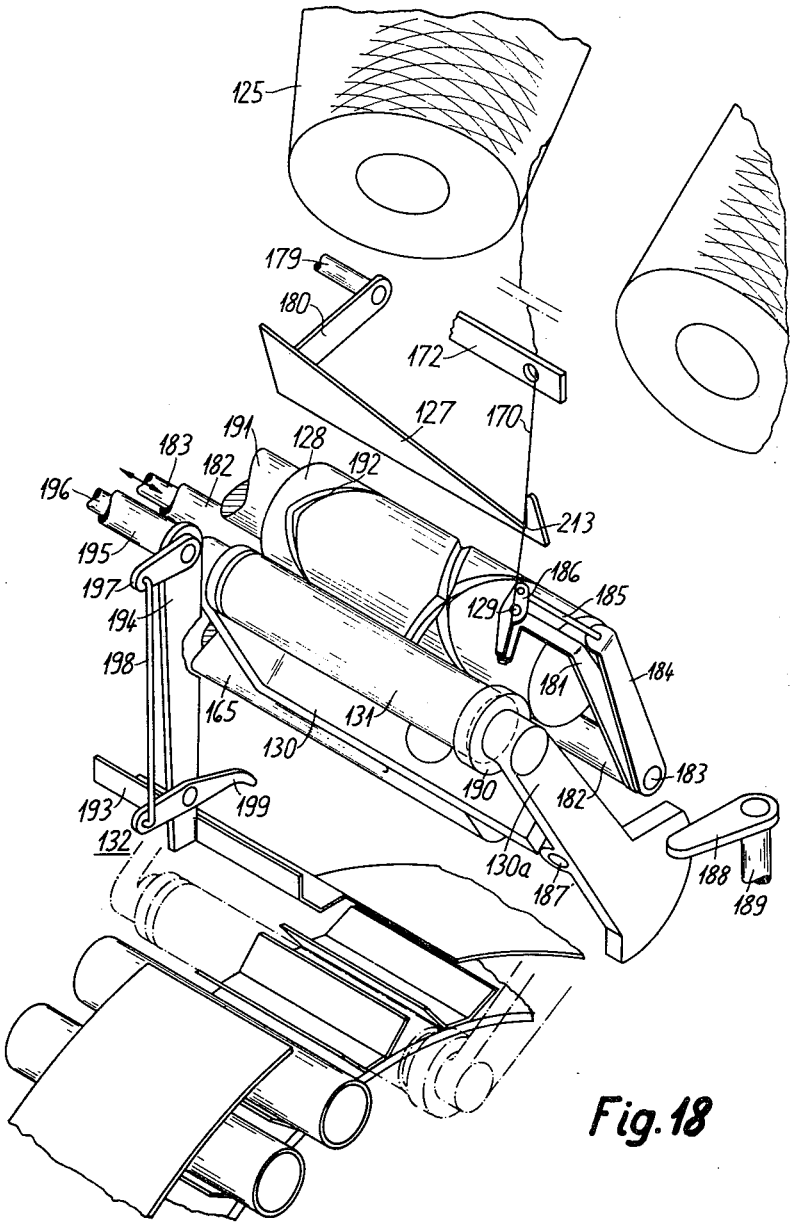
Figure 19:
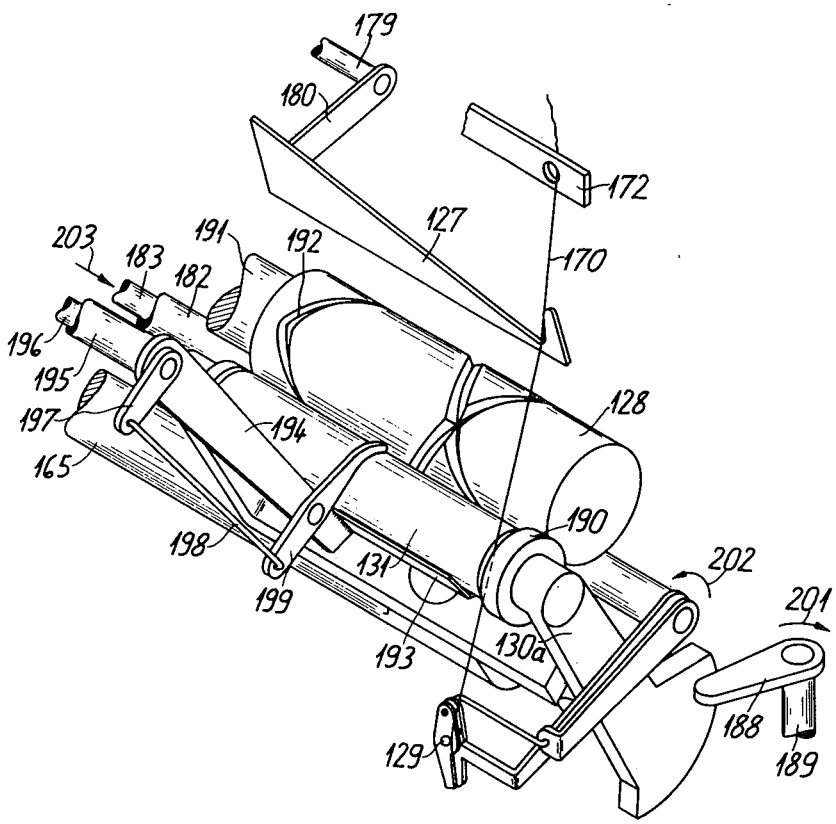

The thread gripper cutter 129 is articulated to the end of a curved lever 181 attached to a hollow shaft 182, as shown particularly in FIG. 18. In the hollow shaft 182, the shaft 183 is concentrically arranged, this latter shaft likewise carrying a lever 184 which is articulated, by way of the rod 185, to the movable cutting blade 186 of the thread gripper cutter 129. The tube creel 130 has a hinge (joint) 187, about which the creel arm 130*a* can be pivoted. To pivot the creel arm 130*a*, a lever 188 is shifted by means of a shaft 189. During this process, the tube carrier 190, which is mounted to the end of the creel arm 130*a* and extends cap-like over the end face of the spool tube 131, releases the spool tube 131.

The winding roll 128 attached to the shaft 191 rotates without interruption. This winding roll is provided with thread guide grooves 192. Before the tube creel 130 places the spool tube 131 against the winding roll 128, the thread 170 is joined to the spool tube 131 so that it is entrained for windup purposes. In this connection, the tube gripper 132 is actuated first of all. The gripper shell 193 of this gripper is located at the end of a lever 194 attached to a quill (hollow) shaft 195. In the quill shaft 195, a shaft 196 is arranged concentrically; this latter shaft carries a lever 197 joined by a hingedly suspended rod 198 with a gripper lever 199. By rotating the quill shaft 195 in the direction of arrow 200 (FIG. 17), the gripper shell 193 is placed underneath the spool tube 131. A rotation of the shaft 196 against the direction of the arrow 200 swings the gripper lever 199 downwardly and retains the spool tube 131 in the gripper shell 193, as can be seen from FIG. 19 of the drawings. At the same time, the shaft 189 is rotated in the direction of arrow 201, and during this step the lever 188 is placed against the broadened lower end of the creel arm 130*a* and thus lifts the tube creel 130 to some extent. Simultaneously, the quill shaft 182 and the shaft 183 are rotated in the direction of arrow 202. The textile thread 170 is thus guided by the thread gripper cutter 129 into the area between the cap-like tube carrier 190 and the end face of the spool tube 131.

Subsequently, the bobbin creel 130 is closed again, the thread gripper cutter 129 is opened by shifting the shaft 183 in the direction of arrow 203 and pivoted, by rotating the shaft 183 and the quill shaft 182 against the direction of arrow 202, into the rest position. At the same time, the tube gripper 132 is also returned into its rest condition illustrated in FIG. 17.

Figure 21:
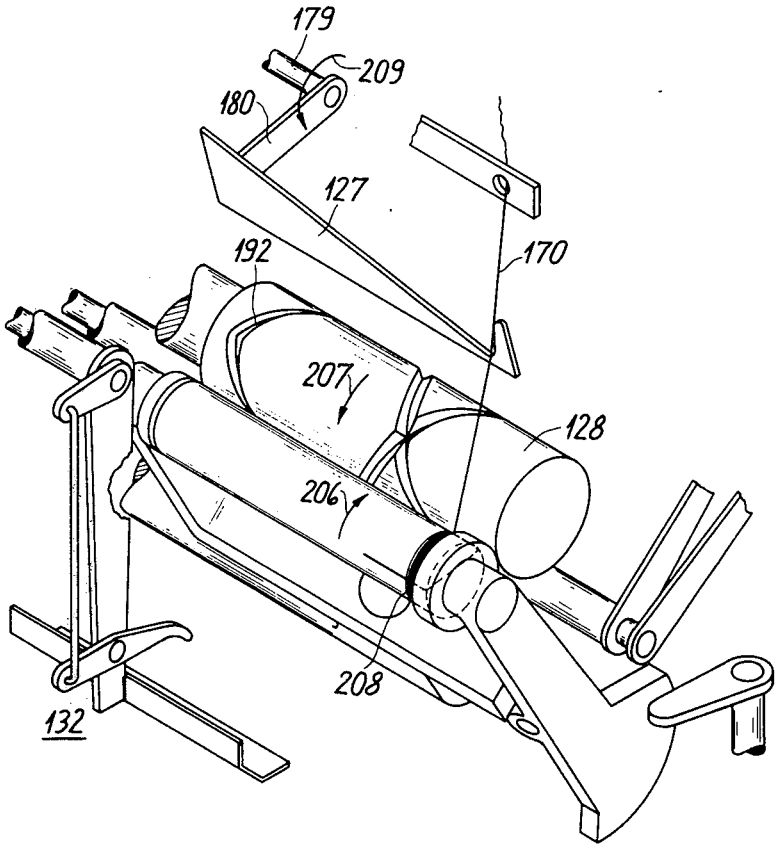
Figure 22:
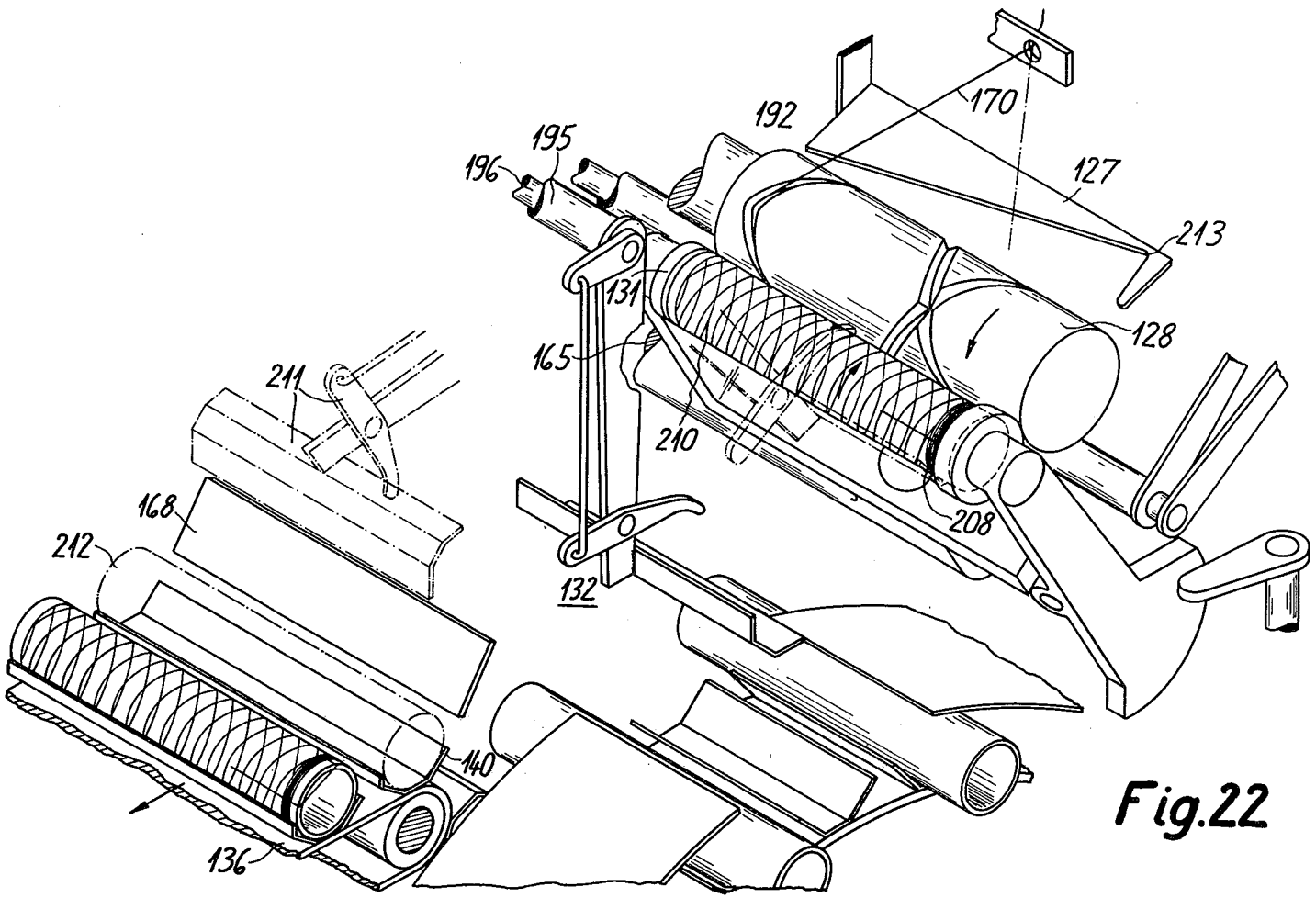

During the closing of the bobbin creel 130, the presently released beginning 205 of the textile thread 170 is clamped between the cap rim 190*a* of the tube carrier 190 and the spool tube 131 and bent so that it points in the direction toward the other tube end, as shown, for example, in FIG. 20*a*. In FIG. 20, the moment is depicted wherein the winding of a thread reserve has just begun. For this purpose, the textile thread 170 is guided through the thread guide plate 127, while the spool tube 131 rotates in the direction of arrow 206 and the winding roll 128 rotates in the direction of arrow 207. In FIG. 21, the instant is illustrated at which the thread reserve 208 has just been finished by the winding operation. As soon as this has been done, the shaft 179 is rotated in the direction of arrow 209, so that the thread guide plate is pivoted downwardly and the textile thread is transferred to a thread guiding groove 192 of the winding roll 128. The starting winding is then produced as can be seen, in particular, from FIG. 22. According to FIG. 22, the spool tube 131 has already several starting windings 210 in addition to the thread reserve 208.

By rotating the shaft 165, the spool tube 131 is lifted off the winding roll 128 after the starting winding has been applied. By a rotation of the quill shaft 195 and the shaft 196, the tube is then seized by the tube gripper 132, transported, preferably after severing the thread 170, over and past the transfer surface 168, and allowed to fall at that point; the tube gripper 132 is than in the position denoted by 211. According to FIG. 22, the spool tube, provided with a thread reserve and with a starting winding, rolls over the transfer surface 168 into the tube pocket 140 of the conveyor belt 136, where it assumes the position denoted by 212. The tube gripper 132 subsequently is pivoted back into the rest position shown in FIG. 17. By rotating the shaft 179 in opposition to the direction of arrow 209 (FIG. 21), the thread guide plate 127 is now lifted, first of all, only to such an extent that the textile thread 170 slides again from the thread guiding groove 192 of the winding roll 128 into the notch 213 of the thread guide plate 127. Thereafter, the thread gripper cutter 129 pivots from the position shown in FIG. 20 into the position shown in FIGS. 17 and 18, again seizes the thread, and severs same. This terminates a complete operating cycle of producing a spool tube provided with a starting winding and with a thread reserve, from its withdrawal from the tube magazine 124 up to its delivery to the magazine 133. As can be seen from FIG. 17, the same operating step will be immediately repeated, because also the next following tube pocket 141 of the conveyor belt 136 is empty.

Figure 23:
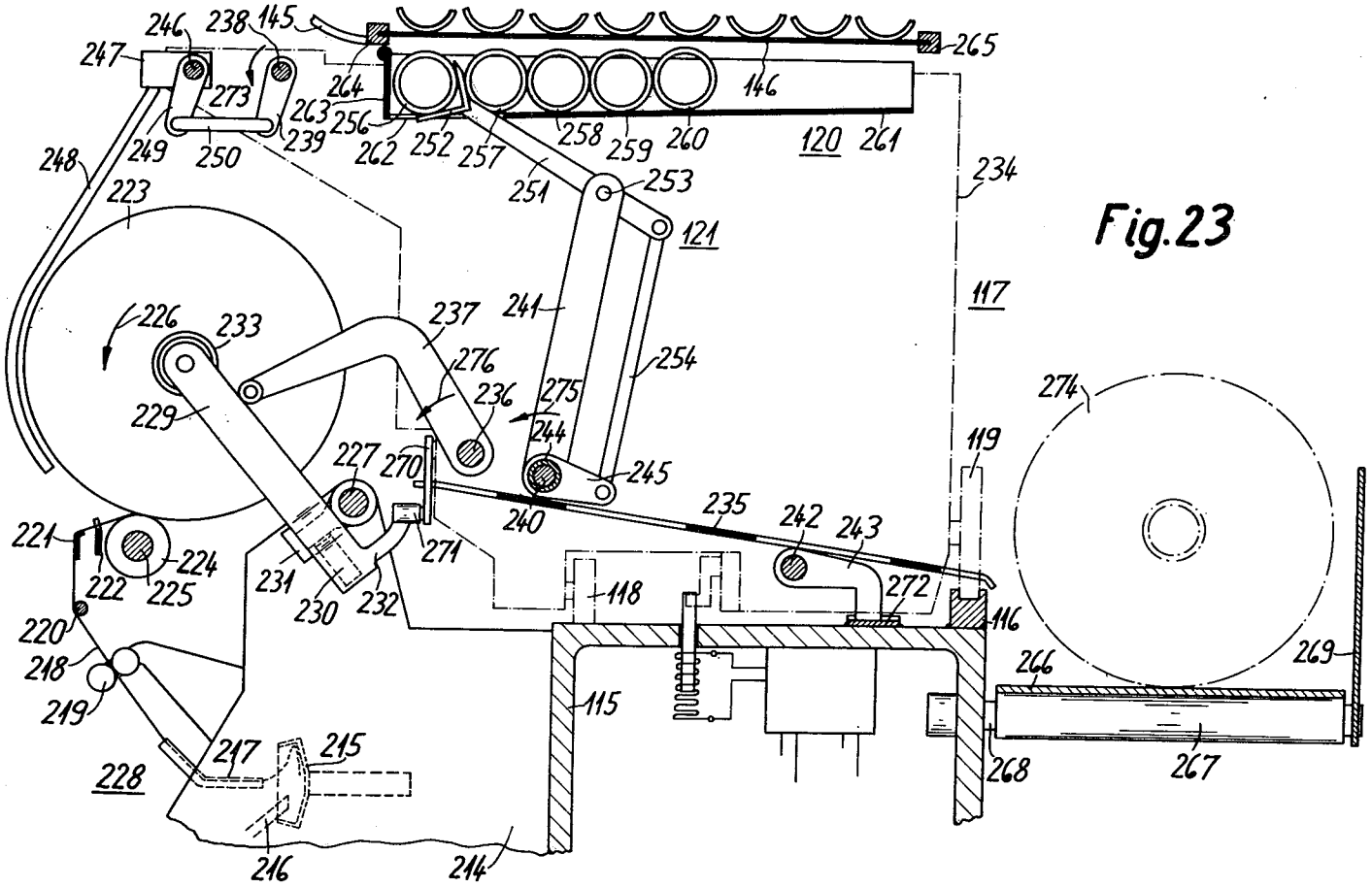
FIG. 23 shows a simplified lateral schematic view of an operating station of the spinning machine shown in FIG. 16 and of the winding spool changing device.

FIG. 23 shows the winding spool changing device 117 in a simplified lateral view. Also, FIG. 23 shows a spinning station 228 of the spinning machine shown in FIG. 16. The housing 214 of the spinning station 228 is attached to the machine frame 115. In the interior of the housing 214, a spinning turbine 215 is indicated, along with a fiber feeding pipe 216 and a take-off pipe 217. The spun thread 218 passes through a take-off device 219, is guided by a thread guiding wire 220, a guide rail 221, and a reciprocating thread guide 222, and is wound up to a winding bobbin 223 which has just reached its maximum cop volume and is to be exchanged against a spool tube provided with a thread reserve and a starting winding. By means of a winding roll 224, attached to the shaft 225, the winding spool 223 is driven and set into rotation in the direction of arrow 226.

A shaft 227 is rotatably mounted within the housing 214. A bobbin holder 229 is connected to the shaft 227 by way of a joint 231 under the force of a leaf spring 230. The bobbin holder 229 carries an extension 232. As soon as a force is exerted on the extension 232 in the direction of the plane of the drawing, the bobbin holder 229 can be pulled off the spool tube 233 of the winding spool 223 against the force of the leaf spring 230.

The housing 234 of the winding spool changing device 117 must be imagined to be located above the plane of the drawing; for this reason, the contours of the housing are illustrated in dot-dash lines. The same holds true for the rollers 118 and 119, on which the winding spool changing device 117 can be moved on the machine frame 115 and the track 116.

A transfer plate 235 extends from the housing 234 in the travel direction. A hold-down means 237 is attached to a shaft 236. A lever 239 is attached to a shaft 238; a lever 241 is mounted to a shaft 240; and a locking lever 243 is attached to a shaft 242, while a lever 245 is mounted to a quill shaft 244. All of the shafts extend from the housing 234 in the travel direction. A base 247 of the spool ejector 248, rotatably mounted on the pin 246, comprises a lever 249 which is articulated with a rod 250 to the lever 239. The lever 251 of a gripper 252 is joined by a joint bolt 253 to the lever 241 and by a rod 254 hingedly to the lever 241, so that a parallelogram guide system is established for the gripper 252. The parts 251–254 constitute the tube feeder 121. In the upper portion, the winding spool changer 117 has the magazine 120 for receiving and delivering the spool tubes 256–260, provided with a thread reserve and a starting winding. The spool tubes are disposed in a box 261 having a slot 262 and a flap 263 for the inward pivoting of the gripper 252. Above the magazine 120 are additional parts which no longer pertain to the winding spool changer 117 but rather are associated with the magazine 133 of the special spooling device 122, namely the deflector plate 145, the slide 146, and two slide guides 264 and 265. Above the slide 146, several spool tubes can furthermore be seen.

On the backside of the machine frame 115, the drawing shows a bobbin conveyor belt 266 and one of the many sliver rollers 267, the axle 268 of which carries on one side a protective shield 269 and is connected on the other side to the machine frame 115. The locking lever 243 of the winding spool changer 117 is in engagement, according to FIG. 23, with the detent 272 of the spinning station 228, and the following sequence is thus actuated.

First of all, the spinning procedure is interrupted. Then a lever 270 joined to the housing 234 is pivoted in the direction of the plane of the drawing, whereby the roller 271 attached thereto presses against the extension 232 of the bobbin holder 229 and opens the latter. During this step, the bobbin holder 229 rotates about the joint 231, and the winding spool 223 is detached from the bobbin holder 229. At this point, the lever 239 is pivoted in the direction of arrow 273 and again returned, whereby the bobbin ejector 248 throws the winding spool 223 onto the transfer plate 235 from where the spool rolls onto the bobbin conveyor belt 266 and there assumes the position denoted by 274. Subsequently, the levers 241 and 245 are rotated in the direction of arrow 275, and the gripper 252 feeds the spool tube 256 to the bobbin holder 229. At the same time, the spool tubes **257*n*–260 roll toward the front in the box 255, which latter is mounted in an inclined position. Now, the lever 270 is returned to its original position, whereby the bobbin holder 229 receives the spool tube 256. After the gripper 252 has been pivoted back into the starting position shown in FIG. 23, the locking lever 243 can be released. The winding spool changer 117** can be moved to another spinning station.

Figure 24:
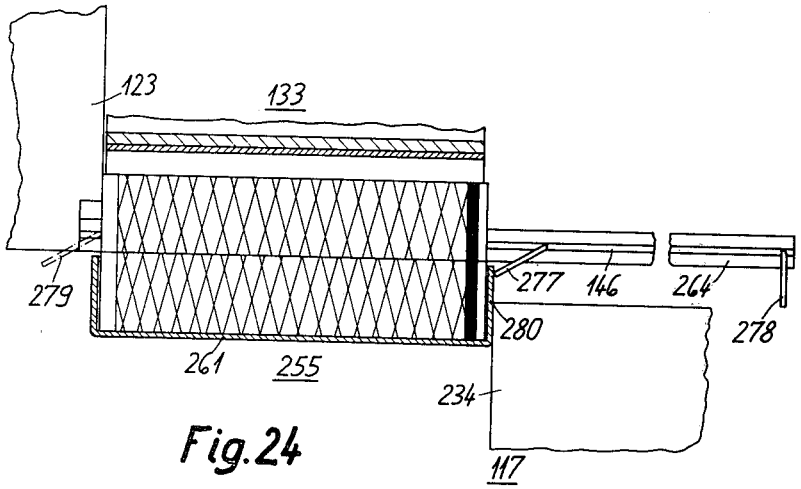
FIGS. 24 and 25 show details of the magazines of the spooling device and the winding spool changing device shown in FIGS. 16 and 17.
Figure 25:
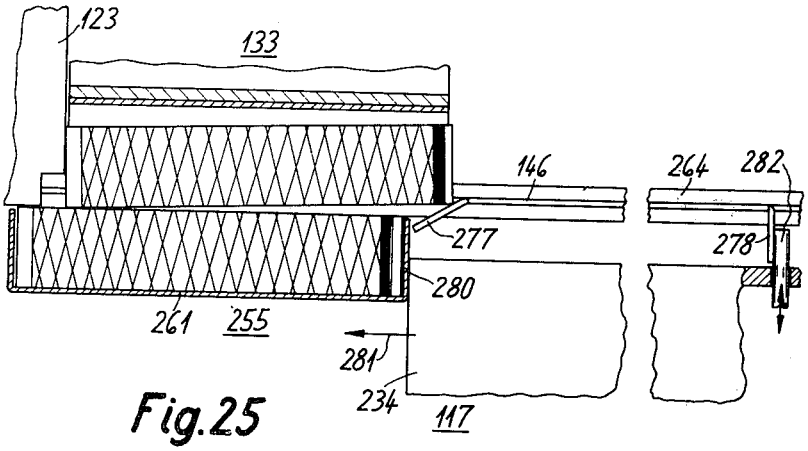

FIGS. 23–25 will serve for explaining how the spool tubes are transferred from the magazine 133 of the separate spooling device 124 to the magazine 120 of the winding spool changer 117. As can be seen from FIG. 23, the box 261 of the magazine 120 is located at a somewhat lower level than the slide 146 of the magazine 133. The slide 146 has two lugs 277 and 278 projecting in the downward direction between the slide guides 264 and 265. As can be seen from FIG. 24, the lug 277 is in position 279, as long as the slide 146 is closed. As soon as the box 261 of the magazine 120, attached to the housing 234 of the winding spool changer 117, approaches the magazine 133, the wall 270 of box 261 contacts the lug 277 of the slide 146, and the latter is entirely pushed aside during the further movement of the winding spool changer and is opened, as illustrated in FIG. 24. As soon as the box 261 is located underneath the magazine 133, the same number of spool tubes as can be accommodated by the box fall from the magazine 133 into the box 261.

At the beginning of the return travel of the winding spool changer 117 in the direction of arrow 281, a plunger 282 is first extended from the housing 234 and is pushed behind the lug 278 of the slide 146, again closing the slide during the further movement of the winding spool changer 117. Any excess spool tubes not received in the box 261 slide along the inclined surface of the lug 277 and return into the magazine 133 of the spooling device, as shown in FIG. 25.

Figure 26:
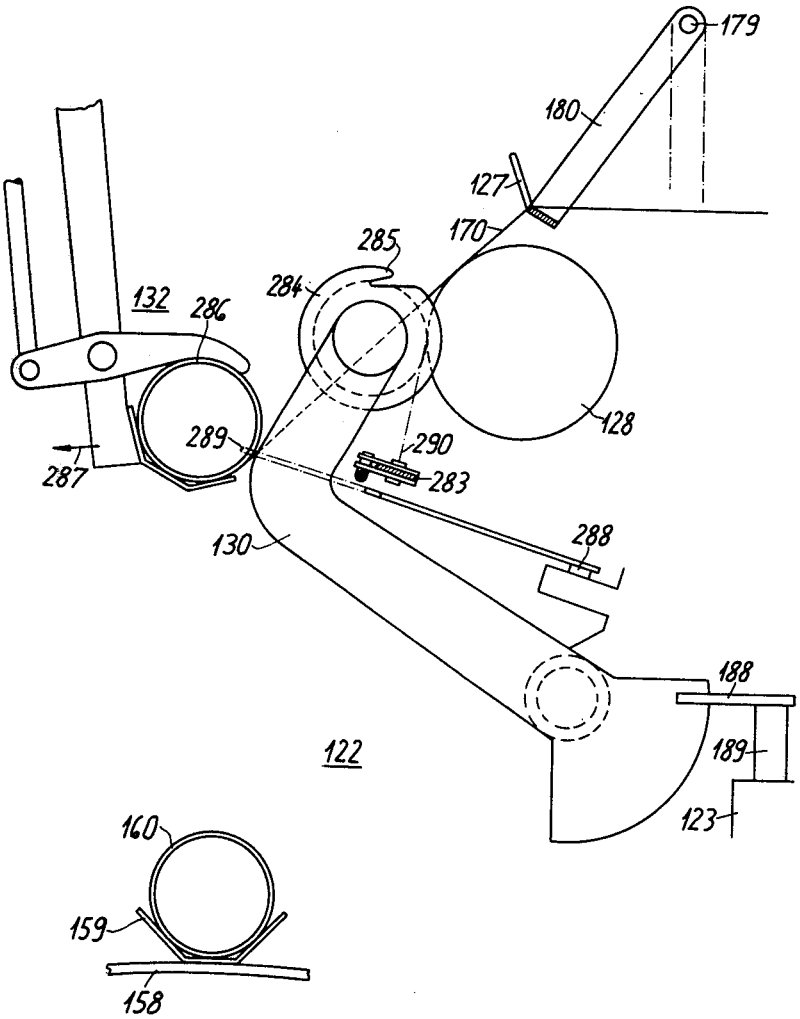
FIG. 26 shows details of an alternative embodiment of the special spooling device.

FIGS. 26–31 show, in fragmentary views, a modification of the special spooling device 122. In FIG. 26, the hoop 158 of the tube magazine 124 is again illustrated with a tube pocket 159 and an empty spool tube 160. The textile thread 170 guided through the thread deflector plate 127 is still connected to the spool tube 286.

Figure 31:
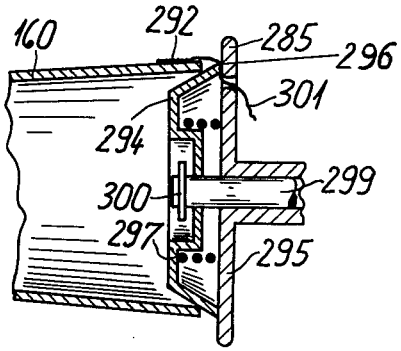

The tube carrier 284, rotatably mounted at the end of the tube creel 130 comprises, as can be seen particularly from FIG. 31, a centering cone 294 with a fitting (adjusting) surface 296 and a clamping element 295 mounted to be movable relatively thereto; this clamping element likewise has a fitting surface in the contact area with the centering cone. Between the centering cone 294 and the clamping element 295, an energy storage means in the form of a compression spring 297 is arranged which, in the relieved condition, moves the two parts away from each other. The centering cone 294 is guided by a pin 299 joined to the clamping element 295 and is secured against sliding off the pin by means of a disk 300 attached to the pin 299. On the periphery of the clamping element 295, a catching or safety lug 285 is arranged so that a thread catching slot 298, formed by the safety lug 285 and the clamping element 295, intersects the fitting surface 296 at an acute angle.

Referring to FIG. 26, the bobbin creel 130, as already described in connection with FIG. 18, can be opened and closed with the aid of lever 188 attached to the shaft 189. Since the tube carrier 284 presently does not hold a tube, the winding roll 128 runs idle. The tube gripper 132 has just withdrawn the spool tube 286, provided with a thread reserve and a starting winding, from the tube carrier 284 and conveys the spool tube in the direction of arrow 287. A thread gripper 289 attached to the shaft 288 is ready to seize the textile thread 170 immediately and feed same to a fixed clamping shear (cutter) 283 which seizes the thread, clamps it in position, and severs it, whereupon the thread assumes the position denoted by 290.

Figure 27:
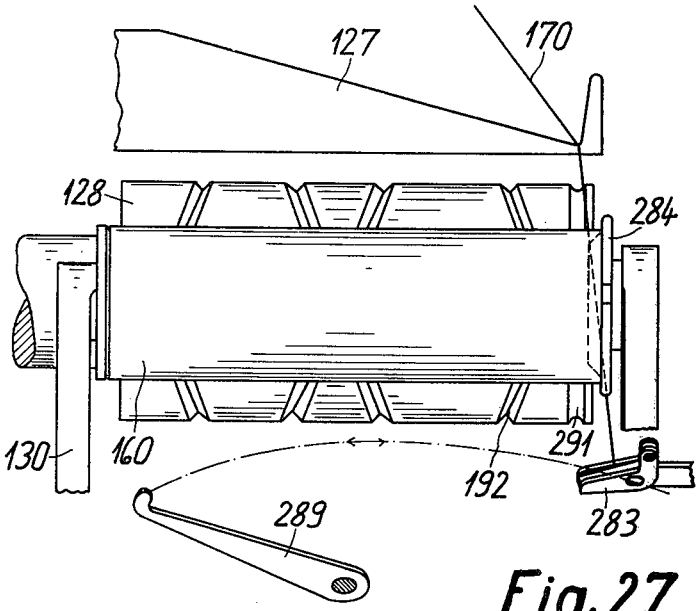
FIGS. 27–31 show further details of the modification illustrated in FIG. 26.
Figure 28:
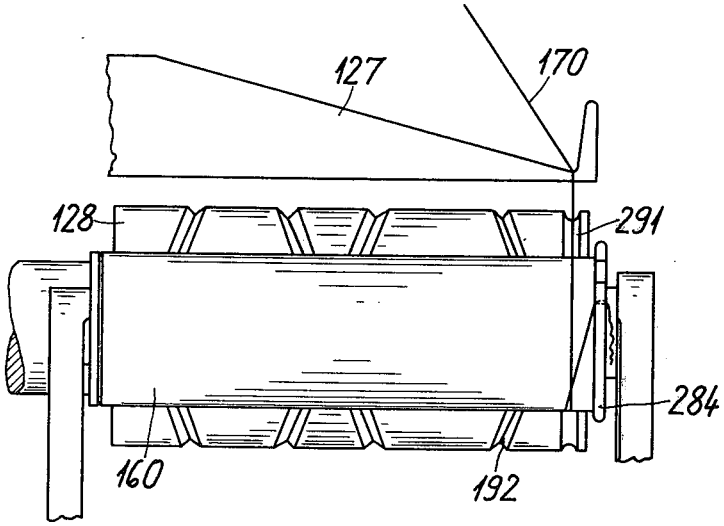

Subsequently, the bobbin creel 130 is pivoted downwardly, whereupon the tube carrier 284 takes the empty spool tube 160 from the tube pocket 159 and lays it against the winding roll 128, as depicted in FIG. 27. The thread gripper 289 has in the meantime been pivoted back into its starting position. As soon as the spool tube 160 commences its rotation, the lug 285 seizes the textile thread 170, pulling the thread end out of the clamping cutter 283 and clamping the thread between the safety lug 285 and the fitting surface 296 of the centering cone 294. Now the thread reserve is wound up. Already at the first lap, the thread end is fixed by winding the thread over it, as shown in FIG. 28.

Figure 29:
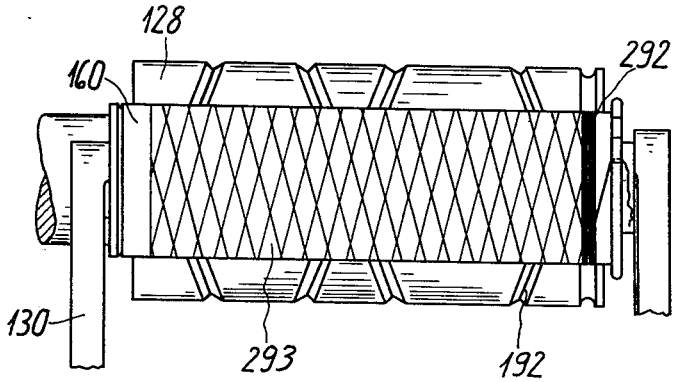
Figure 30:
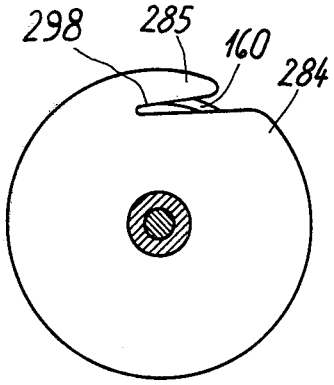

To form the thread reserve, a special thread guiding groove 291 is provided on the winding roll 128. As soon as the thread reserve has been wound up, the thread deflector plate 127 pivots downwardly, whereby the thread is transferred to the thread guiding grooves 192 of the winding roll 128, which form a reverse winding pitch. Thus, a starting winding is produced as already explained in greater detail with reference to FIG. 22. In FIG. 29, the spool tube 160 already carries a thread reserve 292 and a starting winding 293. In FIGS. 30 and 31, the tube carrier 284 is shown on an actual scale, and furthermore illustrated are part of the spool tube 160, as well as the thread reserve 292 and the thread end 301 which is clamped between the fitting surface 296 of the centering cone 294 and the safety lug 285 of the clamping element 295.

The chronological sequence and duration of the afore-described operating steps are ensured by program switching units, for example cam switching systems. These units are not described in detail in order not to obscure the invention and inasmuch as one skilled in the art given the present disclosure and the state of the art could readily construct such units.

While we have shown and described several embodiments in accordance with the present invention, it is understood that the same is not limited thereto but is susceptible of numerous changes and modifications as known to those skilled in the art and we therefore do not wish to be limited to the details shown and described herein but intend to cover all such changes and modifications as are encompassed by the scope of the appended claims.

We claim:

1. Servicing apparatus for automated changing of bobbins in a thread winder for winding thread from an open-end spinning machine comprising:

bobbin removing means for removing a full bobbin from a bobbin holder of said winder at a spinning unit of the spinning machine with thread production being interrupted at said spinning unit, spool tube insertion means for inserting a spool tube into the bobbin holder, spool tube supply means for supplying a spool tube to said spool tube insertion means, and thread section connecting means for connecting a thread section to said spool tube of sufficient length to form a starting winding for accommodating at least a one-time piecing operation and consequent resumption of thread production at said spinning unit, said starting winding being arranged to facilitate return of a free end of the thread section to a spinning rotor of said spinning unit for said piecing operation when said spool tube is in said bobbin holder with said thread section, said bobbin removing means and said spool tube insertion means being carried on a mobile servicing carriage which is selectively movable to respective bobbin exchange positions adjacent respective spinning units of the spinning machine.

2. Apparatus according to claim 1, wherein said spool tube insertion means is carried at a housing on said mobile carriage.

3. Apparatus according to claim 1, wherein said thread section connecting means is mounted for movement along a path adjacent a plurality of spinning stations of an open-end spinning machine.

4. Apparatus according to claim 1, wherein the thread section connecting means includes means for winding the thread section about the tube in the form of a starting winding dimensioned so that a repeated piecing operation can be carried out.

5. Apparatus according to claim 1, wherein the thread section connecting means includes means for fixing a thread section in position at least partially as thread reserve in or on the tube.

6. Apparatus according to claim 5, wherein the thread section connecting means includes means for fixing the thread reserve to the tube in the form of a reserve winding lying outside of the spooling range of the tube.

7. Apparatus according to claim 6, wherein the thread section connecting means includes means for fixing the beginning of the thread in the reserve winding so that said beginning is accessible even after the bobbin has been completed.

8. Apparatus according to claim 1, wherein the thread section connecting means is constructed as a starter winding means which is disposed in a fixed position with respect to the spinning machine, and wherein said tube insertion means includes a transfer device arranged for transferring the tubes provided with the starting winding from the starter winding means to individual spinning stations.

9. Apparatus according to claim 8, wherein the starter winding means means includes means for fixing the thread section in position at least partially as thread reserve in or on the tube.

10. Apparatus according to claim 9, wherein the starter winding means means includes means for fixing the thread reserve to the tube in the form of a reserve winding lying outside of the spooling range of the tube.

11. Apparatus according to claim 10, wherein the starter winding means has thread guiding means for producing a reserve winding on the spool tube laterally of the starting winding, and means for fixing the beginning of the thread in the reserve winding.

12. Apparatus according to claim 11, wherein the thread guiding means are configured for fixing the beginning of the thread by laying a winding on top thereof.

13. Apparatus according to claim 12, wherein the starter winding means comprises clamping means for clamping the thread in position at the end face of the spool tube and for bending the beginning of the thread in the direction toward the other tube end.

14. Apparatus according to claim 13, characterized in that the clamping device for the tube has a cap extending over a tube rim formed at the end of the tube.

15. Apparatus according to claim 8, wherein the starter winding means means includes means for winding the thread section about the tube in the form of a starting winding dimensioned so that a repeated piecing operation can be carried out.

16. Apparatus according to claim 8, wherein the starter winding means has thread guiding means for producing a reserve winding on the spool tube laterally of the starting winding, and means for fixing the beginning of the thread in the reserve winding.

17. Apparatus according to claim 16, wherein the thread guiding means are configured for fixing the beginning of the thread by laying a winding on top thereof.

18. Apparatus according to claim 17, wherein the starter winding means comprises clamping means for clamping the thread in position at the end face of the spool tube and for bending the beginning of the thread in the direction toward the other tube end.

19. Apparatus according to claim 18, characterized in that the clamping device for the tube has a cap extending over a tube rim formed at the end of the tube.

20. Apparatus according to claim 16, wherein a clamping cutter is arranged in the immediate vicinity of a tube carrier of the starter winding means.

21. Apparatus according to claim 8, wherein a magazine for one or more spool tubes provided with a starting winding is associated with the starter winding means.

22. Apparatus according to claim 21, wherein the transfer device includes means arranged at one of the bobbin changers and the starter winding means for the simultaneous seizure of several spool tubes provided with starting winding and thread reserve from the magazine, and for transferring the spool tubes into a magazine associated with a mobile unit of the transfer device.

23. Apparatus according to claim 1, wherein the thread section connecting means is constructed as a starter winding means carried on said mobile carriage which travels along and applies the thread sections in the form of starting windings for accommodating piecing operations and thread reserve windings to the spool tubes, this starter winding means comprising at least one auxiliary bobbin which furnishes the thread for said thread sections.

24. Apparatus according to claim 1, wherein the thread section connecting means is constructed as a device having a tube carrier including a thread-catching and clamping mechanism.

25. Apparatus according to claim 24, wherein the thread-catching and clamping mechanism includes a catching lug pointing in the direction of rotation of the spool tube.

26. Apparatus according to claim 25, wherein the thread-catching and clamping mechanism includes means for automatically releasing when the tube is released.

27. Apparatus according to claim 24, wherein the thread-catching and clamping mechanism includes means for automatically releasing when the tube is released.

28. Apparatus according to claim 24, wherein the tube carrier includes a centering cone and a clamping element movable releative thereto, and wherein fitting surfaces are provided in a contact zone of the clamping element with the centering cone.

29. Apparatus according to claim 28, wherein the thread-catching and clamping mechanism includes means for automatically releasing when the tube is released.

30. Apparatus according to claim 28, wherein at least one energy storage means is arranged between the centering cone and the clamping element separating the two components from each other.

31. Apparatus according to claim 30, wherein said energy storage means is constructed as a compression spring.

32. Apparatus according to claim 30, wherein the catching lug is disposed on the periphery of the clamping element, and wherein a thread-catching slot formed by the catching lug and the clamping element intersects at an acute angle the fitting surface of the centering cone.

33. Apparatus according to claim 28, wherein the catching lug is disposed on the periphery of the clamping element, and wherein a thread-catching slot formed by the catching lug and the clamping element intersects at an acute angle the fitting surface of the centering cone.

34. Apparatus according to claim 1, wherein said insertion means includes a device located in the zone of a spinning station to be serviced for seizing a spool tube provided with a starting winding and for transferring the spool tube to a bobbin holder of said spinning station.

35. Apparatus according to claim 1, wherein said insertion means includes a device for withdrawing a tube from a magazine and for introducing the tube in a bobbin holder, and wherein said joining means includes a device connecting a thread to the tube, which thread is pulled off a bobbin with the aid of a take-off means and is cut to a predetermined length.

36. Apparatus according to claim 35, wherein the bottom of the magazine of the spool tubes contains at least one conveyor chain subdivided by dogs into individual compartments and being driven in a rhythmic fashion, this chain terminating in the zone of a gripper.

37. Apparatus according to claim 36, wherein a gripper is disposed on a swivel arm which can be pivoted with the spool tube through the range of a thread which is withdrawn from the auxiliary bobbin with the aid of the take-off means.

38. Apparatus according to claim 37, wherein the magazine for the spool tubes lies in a zone passing in front of the spinning station and is formed from several wells disposed side-by-side, and wherein the tubes are accommodated with their axes extending at right angles to the traveling direction.

39. Apparatus according to claim 38, wherein the magazine is followed by a turning device for the spool tubes.

40. Apparatus according to claim 37, wherein said insertion means further comprises a device for lifting and releasing a bobbin creel, this last-mentioned device being preferably controlled in dependence on the movement of the gripper.

41. Apparatus according to claim 1, wherein a magazine for one or more spool tubes provided with a starting winding is associated with the thread section connecting means.

42. Apparatus according to claim 1, wherein said thread section connecting means includes at least one auxiliary bobbin which provides the thread section.

43. Apparatus according to claim 42, wherein the auxiliary bobbin is associated with an unwinding roll equipped with a drive mechanism.

44. Apparatus according to claim 42, wherein the auxiliary bobbin is associated with a funnel-shaped guide element to which can be connected a take-off means fashioned as a suction means and disposed on a swivel arm or the like.

45. Apparatus according to claim 44, wherein the outlet of the guide element is provided with one of a thread clamping means and a thread brake.

46. Apparatus according to claim 45, wherein a thread severing device is arranged in the zone of the outlet of the guide element.

47. Apparatus according to claim 44, wherein a thread severing device is arranged in the zone of the outlet of the guide element.

48. Apparatus according to claim 47, wherein the swivel arm of the take-off means is provided with a cutting blade.

49. Apparatus according to claim 1, wherein a starter winding means of the thread section connecting means is associated with a spooling station of the spinning machine for the thread required to form a starting winding and/or a thread reserve.

50. Apparatus according to claim 1, wherein a starter winding means of the thread section connecting means is associated with the bobbin to be exchanged, present in the spinning station to be serviced, for the thread required to form a starting winding and/or a thread reserve.

51. Apparatus according to claim 1, wherein the thread section connecting means includes take-off means for stretching the thread between itself and a bobbin or auxiliary bobbin in a zone where an auxiliary means is provided for transferring the thread to the spool tube guided past the thread.

52. Apparatus according to claim 1, wherein the insertion means is associated with one or more additional servicing units, especially a cleaning device for the spinning station and/or a piecing device.

53. Apparatus according to claim 52, wherein the insertion means forms a structural unit with one or more further servicing devices.

54. Apparatus to claim 53, wherein the devices for effecting the exchange of the bobbin and the spool tube are arranged above the additional servicing unit so that both servicing devices can be simultaneously associated with the same spinning station.

55. Apparatus according to claim 52, wherein the devices for effecting the exchange of the bobbin and the spool tube are arranged above the additional servicing unit so that both servicing devices can be simultaneously associated with the same spinning station.

56. Apparatus according to claim 52, wherein the devices for effecting the exchange of the bobbin and the spool tube and the additional servicing unit are arranged to be mutually offset at least by the width of one spinning station.

57. Apparatus according to claim 1, wherein said thread section connecting means is carried on said servicing carriage.

58. Apparatus according to claim 57, wherein said thread section connecting means is carried at a housing on said machine carriage.

59. Apparatus according to claim 58, wherein the thread section connecting means includes take-off means for stretching the thread between itself and the bobbin or auxiliary bobbin in a zone where an auxiliary means is provided for transferring the thread to the spool tube guide past the thread.

60. Apparatus according to claim 57, wherein a starter winding means of the thread section connecting means is associated with the bobbin to be exchanged, present in the spinning station to be serviced, for the thread required to form a starting winding and/or a thread reserve.

61. Apparatus according to claim 57, wherein the thread section connecting means includes take-off means for stretching the thread between itself and a bobbin or auxiliary bobbin in a zone where an auxiliary means is provided for transferring the thread to the spool tube guided past the thread.

62. Apparatus according to claim 57, wherein a thread gripper serves as an auxiliary device for transferring the thread to the spool tube, this gripper being axially insertable in a spool tube guided past the gripper and there deposits a thread reserve, withdrawn by the gripper from an auxiliary bobbin.

63. Apparatus according to claim 62, wherein the thread gripper contains two parts having the shape of tines, thus receiving the thread between them and winding it up by rotating about a common axis, these parts being insertable axially in a spool tube comprising a stripper means for the thread reserve wound onto the tube.

64. Apparatus according to claim 57, wherein the thread section connecting means includes a take-off means oriented toward a bobbin or auxiliary bobbin and fashioned as a transfer device for transferring the thread to a spool tube which is guided past the thread.

65. Apparatus according to claim 64, wherein a suction nozzle serves as the take-off means, which can be placed into a position coaxial with respect to a spool tube guided past this nozzle and which in communication, in the zone of its mouth, with a blowing nozzle which can be subjected to compressed air.

66. Apparatus according to claim 64, wherein a suction nozzle serves as the take-off means, this nozzle being provided with a rotary drive and the orifice of which can be driven to execute circular movements about the spool tube guided past the nozzle.

67. Apparatus according to claim 1, wherein said thread section connecting means includes means for joining a thread section to said spool tube prior to insertion of said spool tube into said bobbin holder.

68. Apparatus according to claim 67, wherein a starter winding means of the thread section connecting means is associated with a spooling station of the spinning machine for the thread required to form a starting winding and/or a thread reserve.

69. Apparatus according to claim 1, further comprising starting winding supply means, said starting winding supply means including thread section joining means for joining a thread section to said spool tube.

70. Apparatus according to claim 1, wherein said thread section connecting means is constructed as a starter winding means comprising:

means for attaching a reserve thread section to spool tubes with an end of said reserve thread section disposed to be readily accessible even after a bobbin has been completed on said spool tube, and means for attaching a starting winding thread section to said spool tube, said starting winding being formed by a continuation of said reserve thread section and being of said sufficient length to accommodate at least a one-time piecing operation at an open-end spinning station.

71. Apparatus according to claim 70, wherein said means for attaching a reserve thread section includes means for placing said reserve thread section inside of said spool tube.

72. Apparatus according to claim 71, wherein said means for attaching a starting winding thread section includes means for winding said starting winding on the outside of said spool tube and for positioning the end of said starting winding opposite the ends of said reserve thread section at a predetermined position on said spool tube.

73. Apparatus according to claim 71, wherein said means for placing said reserve thread section inside of said spool tube includes suction means.

74. Apparatus according to claim 71, wherein said means for placing said reserve thread section inside of said spool tube includes rotating opposed tine means.

75. Apparatus according to claim 70, wherein said means for attaching a starting winding thread section includes means for winding said starting winding on the outside of said spool tube and for positioning the end of said starting winding opposite the ends of said reserve thread section at a predetermined position on said spool tube.

76. Apparatus according to claim 70, further comprising storage magazine means for accommodating a plurality of spool tubes with attached reserve thread sections and starting winding section.

77. Apparatus according to claim 1, wherein said thread section connecting means includes means separate from said servicing carriage and said spinning machine for attaching reserve and starting winding sections to spool tubes, and wherein a spool transfer device is provided for transferring spool tubes with attached reserve and starting winding thread sections to the spinning units, the transfer device comprising:

magazine means for storing a plurality of spool tubes with attached reserve and starting winding thread sections, and transfer means for transferring said spool tubes to respective bobbin holders at said spinning units.

78. Apparatus according to claim 77, further comprising means for moving said transfer device along a path adjacent a plurality of said spinning units.

79. Apparatus according to claim 78, wherein one of cleaning device means and piecing means are attached to and movable with said spool transfer device.

* * * * *